US008851335B2

(12) United States Patent
Ciavarella et al.

(10) Patent No.: US 8,851,335 B2
(45) Date of Patent: Oct. 7, 2014

(54) WATER-DRIVEN DISPENSING SYSTEMS EMPLOYING CONCENTRATED PRODUCT

(75) Inventors: Nick E. Ciavarella, Seven Hills, OH (US); Paul R. Metcalfe, Solon, OH (US)

(73) Assignee: GOJO Industries, Inc., Akron, OH (US)

( * ) Notice: Subject to any disclaimer, the term of this patent is extended or adjusted under 35 U.S.C. 154(b) by 162 days.

(21) Appl. No.: 13/448,666

(22) Filed: Apr. 17, 2012

(65) Prior Publication Data

US 2013/0270300 A1 Oct. 17, 2013

(51) Int. Cl.
*B67D 7/76* (2010.01)
*B65D 88/54* (2006.01)

(52) U.S. Cl.
USPC ..... 222/325; 222/190; 222/372; 222/334; 222/145.6; 222/133

(58) Field of Classification Search
USPC ..... 137/564.5; 222/133, 190, 334, 63, 173, 222/325, 145.6, 335, 373, 372, 129.2, 61
See application file for complete search history.

(56) References Cited

U.S. PATENT DOCUMENTS

| | | | | |
|---|---|---|---|---|
| 484,383 | A * | 10/1892 | Watherhead | 222/334 |
| 1,147,185 | A | 7/1915 | Phillips | |
| 2,685,985 | A * | 8/1954 | Howell, Jr. | 222/134 |
| 2,785,833 | A * | 3/1957 | Bauerlein et al. | 222/108 |
| 4,181,242 | A * | 1/1980 | Zygiel et al. | 222/1 |
| 4,955,507 | A * | 9/1990 | Kirschner et al. | 222/63 |
| 5,033,649 | A | 7/1991 | Copeland et al. | |
| 5,215,216 | A | 6/1993 | Van Marcke | |
| 5,230,368 | A * | 7/1993 | Berfield | 137/889 |
| 5,540,362 | A | 7/1996 | Azuma et al. | |
| 5,738,248 | A * | 4/1998 | Green | 222/129.2 |
| 5,781,942 | A | 7/1998 | Allen et al. | |
| 6,206,241 | B1 * | 3/2001 | Terrell et al. | 222/63 |
| 6,371,386 | B1 | 4/2002 | Hoy | |
| 7,364,053 | B2 * | 4/2008 | Ophardt | 222/190 |
| 7,458,523 | B2 | 12/2008 | Hyslop | |
| 8,087,545 | B2 * | 1/2012 | Ciavarella et al. | 222/153.09 |
| 8,371,474 | B2 * | 2/2013 | Tramontina et al. | 222/1 |
| 2003/0126678 | A1 | 7/2003 | Wright et al. | |
| 2004/0050876 | A1 * | 3/2004 | Muderlak et al. | 222/333 |
| 2004/0069802 | A1 | 4/2004 | Frankel | |
| 2009/0000024 | A1 | 1/2009 | Louis et al. | |
| 2011/0027148 | A1 | 2/2011 | Zlatic et al. | |
| 2011/0215115 | A1 * | 9/2011 | Proper | 222/173 |

FOREIGN PATENT DOCUMENTS

WO 2011017753 A1 2/2011

* cited by examiner

*Primary Examiner* — Kevin P Shaver
*Assistant Examiner* — Patrick M Buechner
(74) *Attorney, Agent, or Firm* — Renner Kenner Greive Bobak Taylor & Weber

(57) ABSTRACT

A dispenser for dispensing a diluted form of a concentrated product includes: a supply of concentrated product; a dilution chamber; an actuation assembly and a product pump mechanism having a water staging chamber. The actuation assembly receives water under pressure from a pressurized water supply. In a staging state, water from the pressurized water supply is fed to the water staging chamber, increasing the volume thereof and causing the actuating of the pump mechanism thereby driving a dose of product into the dilution chamber. In a return state, (a) water within the water staging chamber exits the water staging chamber, (b) water is advanced to the dilution chamber and mixes with the dose of product to create diluted product, and (c) a dose of concentrated product is drawn from the supply of concentrated product into the product pump mechanism.

24 Claims, 21 Drawing Sheets

WATER-DRIVEN DISPENSING SYSTEMS EMPLOYING CONCENTRATED PRODUCT

FIELD OF THE INVENTION

The present invention generally relates to dispensers for liquid or gel type products, and in particular embodiments, to counter-mounted dispensers. More particularly, the present invention relates to dispensers that employ a pressurized water source, typically a public water supply, to drive pump mechanisms that dispense the product. Yet more particularly, the product to be dispensed is a concentrated product, and the pressurized water source is also employed to dilute that concentrated product before dispensing. In particular embodiments the concentrated product is diluted and dispensed as a liquid product, while, in other embodiments, it is further mixed with air to be dispensed as a foam product. In a specific embodiment the concentrated product is a soap for use in personal hygiene.

BACKGROUND OF THE INVENTION

Soap dispensers are well-known and the prior art includes a vast number of such dispensers. In recent years, the soap dispensers that dispense soap in a generally liquid form are being replaced by preferred soap dispensers that dispense the soap in the form of a foam. In these dispensers, liquid soap is combined with air and agitated, typically by forcing a mixture of air and liquid soap through one or more screens, to disperse air bubbles within the soap, thereby creating a foamed soap product. Most often, these dispensers include pumps that are either manually driven or driven by electronic means to collapse an air chamber and a soap chamber to thereby effect the mixing of the components. The air is typically drawn from the ambient atmosphere, while the liquid soap is typically fed from a container holding a bulk supply of soap. In some dispensers, the pump and bulk supply of soap are provided in one unit, often called a "refill unit" and so named because, when the soap container of such a unit is empty, the entire unit is removed from the remainder of the dispensing system and replaced by a new unit, thus refilling the dispensing system with soap.

In prior art counter-mounted dispensing systems, the refill units or bulk supplies of soap are typically provided under the counter. That is, maintenance personnel or other appropriate individuals must access the soap container or refill unit by accessing space under the counter. Such awkward positioning of the soap containers/refill units make them difficult and unpleasant to replace. Thus, the soap dispensing arts might be improved by the provision of dispensing systems wherein the soap containers or refill units can be installed into the dispensing system at a position at the exposed and easily accessed top surface of the counter.

Notably, the liquid soaps employed in prior art dispensing systems include a significant amount of liquid (typically water) and therefore the bulk containers or refill units can be quite large in order to hold an appropriate number of dispensing doses of soap. Such voluminous containers are not likely to be aesthetically pleasing when mounted above a counter in a counter-mounted dispensing system. And, while this may not be an issue when mounting such containers under a counter, the bulkiness of the container contributes to the awkwardness of accessing the space under the counter and installing the container/refill unit. Thus, the art would benefit from dispensing systems that employ concentrated soaps such that a desirable number of doses can be provided in a given soap container or refill unit without requiring them to be very voluminous.

Dispensing systems are typically actuated manually or by electronic means. Manually-actuated dispensers typically provide a push bar or plunger that must be pressed by the user to cause the actuation of the pumping mechanisms that result in the dispensing of a dose of soap or foamed soap. Common electronic systems typically provide a sensor that can sense the presence of a hand below a dispensing location, and, upon sensing the presence of a hand, causes motors and/or gearing and the like to actuate the pump mechanisms, causing a dose of soap to be automatically dispensed to the hand. Such electronic systems must somehow be powered, whether by batteries or a mains power supply. A mains power supply consumes energy, and thus also paid for, and batteries must be replaced when expired, which also must be paid for. To reduce the realized cost of the system, the prior art would benefit from a dispensing system that has a very minimal power supply requirement.

In the art of dispensers in general, there is a need for a practical system for employing a concentrated product, diluting that product to an acceptable concentration before dispensing. The concentrated product shipped for refilling empty dispensers would therefore provide more useful doses per unit volume thus providing a greener alternative to the more bulky non-concentrated products most commonly employed. In those dispensers that employ refill units, the refill unit can be smaller and more easily manipulated, particularly in counter-mounted soap dispensers in which it is often difficult to manipulate and properly install the refill units of the prior art. There is also a need to provide a dispenser wherein the power required to drive the dispenser components to dispense product is reduced. Various dispenser embodiments are disclosed herein to satisfy one or more—and in some instances all—of the above needs.

SUMMARY OF THE INVENTION

In a first embodiment, this invention provides a refill unit for a product dispenser, the refill unit comprising: a supply of concentrated product; a dilution chamber having an inlet for said concentrated product and an inlet for water; a product pump mechanism including: a product chamber that fluidly communicates with said supply of concentrated product and fluidly communicates with said dilution chamber, said product chamber structured to decrease in volume upon actuation of said product pump mechanism to thereby drive a dose of product from said product chamber toward said dilution chamber, said product chamber further structured to increase in volume after actuation of said product pump mechanism to thereby draw a dose of product from said supply of concentrated product into said product chamber.

In a second embodiment, this invention provides a refill unit as in the first embodiment, further comprising a housing, said supply of concentrated product and said product pump mechanism being held within said housing.

In a third embodiment, this invention provides a refill unit as in either the first or second embodiments, wherein said housing is faucet-shaped to provide a common faucet-type appearance in use in a counter-mounted product dispenser.

In a fourth embodiment, this invention provides a refill unit as in any of the first through third embodiments, further comprising a dispensing tube fluidly communicating with said dilution chamber and extending through said housing to a dispensing outlet.

In a fifth embodiment, this invention provides a refill unit as in any of the first through fourth embodiments, further comprising a water inlet port providing fluid communication to said dilution chamber.

In a sixth embodiment, this invention provides a refill unit as in any of the first through fifth embodiments, further comprising a foaming chamber, said dilution chamber fluidly communicating with said foaming chamber.

In a seventh embodiment, this invention provides a refill unit as in any of the first through sixth embodiments, further comprising an air inlet communicating with an air passage that bypasses said dilution chamber to fluidly communicate with said foaming chamber.

In an eighth embodiment, this invention provides a refill unit as in any of the first through seventh embodiments, further comprising a retention plate member having a piston aperture therein, said piston aperture providing access to said product chamber.

In a ninth embodiment, this invention provides a refill unit as in any of the first through eighth embodiments, wherein said concentrated product is concentrated soap.

In a tenth embodiment, this invention provides a refill unit as in any of the first through ninth embodiments, wherein said dilution chamber includes a tortuous mixing path having a product inlet, a water inlet and an exit.

In a eleventh embodiment, this invention provides a refill unit as in any of the first through tenth embodiments, wherein the product chamber is defined by a plug maintained in a plug housing.

In a twelfth embodiment, this invention provides a refill unit as in any of the first through eleventh embodiments, wherein said product chamber is defined by a flexible dome movable toward a base to decrease the volume of said product chamber.

In a thirteenth embodiment, the present invention provides a dispenser for dispensing a diluted form of a concentrated product, the dispenser comprising: a supply of concentrated product; a dilution chamber; a product pump mechanism including: a product chamber that fluidly communicates with said supply of concentrated product and fluidly communicates with said dilution chamber; a water staging chamber; and an actuation assembly having a rest state, a staging state and a return state, said actuation assembly receiving water under pressure from a pressurized water supply, wherein, in said staging state, water from said pressurized water supply is fed to said water staging chamber, increasing the volume thereof and causing the actuating of said pump mechanism by decreasing the volume of said product chamber and thereby driving a dose of product into said dilution chamber, and, in said return state, (a) water within said water staging chamber exits said water staging chamber, (b) water is advanced to said dilution chamber and mixes with said dose of product to create diluted product, and (c) said product chamber increases in volume and draws a dose of product from said supply of concentrated product into said product chamber.

In a fourteenth embodiment, this invention provides a dispenser as in the thirteenth embodiment, further comprising a housing, said supply of concentrated product and said product pump mechanism being held within said housing.

In a fifteenth embodiment, this invention provides a dispenser as in either the thirteenth or fourteenth embodiments, wherein the product pump mechanism includes a piston assembly having a product piston reciprocally received in said product chamber said product piston being biased toward a rest position, and in said staging state, increasing the volume of said staging chamber results in the actuating of said pump mechanism by moving said product piston to decrease the volume of said product chamber and drive a dose of product into said dilution chamber.

In a sixteenth embodiment, this invention provides a dispenser as in any of the thirteenth through fifteenth embodiments, further comprising a plug in said product chamber, wherein said product piston contacts said plug to move said plug.

In a seventeenth embodiment, this invention provides a dispenser as in either the thirteenth or sixteenth embodiments, wherein said actuation assembly includes a control rod reciprocally movable within a drive-water sleeve that holds water under pressure from said pressurized water supply, said control rod having a staging chamber inlet passage and a staging chamber outlet passage, wherein, in said rest state said control rod blocks the passage of water from said drive-water sleeve to said staging chamber, and, in said staging state, said control rod is moved so that said staging chamber inlet passage provides fluid communication between said staging chamber and the water within the said drive-water sleeve, such that water under pressure from said pressurized water supply enters said staging chamber, and, in said return state, said control rod is moved to be returned to its rest position and said staging chamber outlet passage provides fluid communication between said staging chamber and said dilution chamber, such that the water within said staging chamber advances through said staging chamber outlet passage toward said dilution chamber.

In an eighteenth embodiment, this invention provides a dispenser as in any of the thirteenth through seventeenth embodiments, wherein said actuation assembly includes driven by a solenoid, gearbox or eccentric.

In a nineteenth embodiment, this invention provides a dispenser as in any of the thirteenth through eighteenth embodiments, wherein said actuation assembly includes a manually-driven plunger, said plunger operatively connected to said control rod such that manually pressing said plunger moves said control rod to said staging state.

In a twentieth embodiment, this invention provides a dispenser as in any of the thirteenth through nineteenth embodiments, wherein said actuation assembly includes a valved manifold, wherein, in said rest state, said valved manifold blocks the passage of water under pressure from said pressurized water source to said staging chamber, and, in said staging state, said valved manifold provides fluid communication between said staging chamber and the water under pressure from said pressurized water source, such that water under pressure from said pressurized water supply enters said staging chamber, and, in said return state, said valved manifold provides fluid communication between said staging chamber and said dilution chamber, such that the water within said staging chamber advances toward said dilution chamber.

In a twenty-first embodiment, this invention provides a dispenser as in any of the thirteenth through twentieth embodiments, wherein said housing, said supply of concentrated product, said dilution chamber and said product pump mechanism form a refill unit that is removable as a unit from the dispenser so as to be replaced with a new refill unit.

In a twenty-second embodiment, this invention provides a dispenser as in any of the thirteenth through twenty-first embodiments, further comprising an air pump mechanism.

In a twenty-third embodiment, this invention provides a dispenser as in any of the thirteenth through twenty-second embodiments, further comprising a foaming chamber, said dilution chamber fluidly communicating with said foaming chamber.

In a twenty-fourth embodiment, this invention provides a dispenser as in any of the thirteenth through twenty-third embodiments, wherein said air pump mechanism includes: an air chamber that fluidly communicates with ambient air and fluidly communicates with said foaming chamber, said foaming chamber receiving and mixing said diluted product and air from said air pump mechanism to create a foam product.

In a twenty-fifth embodiment, this invention provides a dispenser as in any of the thirteenth through twenty-fourth embodiments, a dispensing tube fluidly communicating with said dilution chamber and extending to a dispensing outlet.

DETAILED DESCRIPTION OF ILLUSTRATIVE EMBODIMENTS

Figure 1:
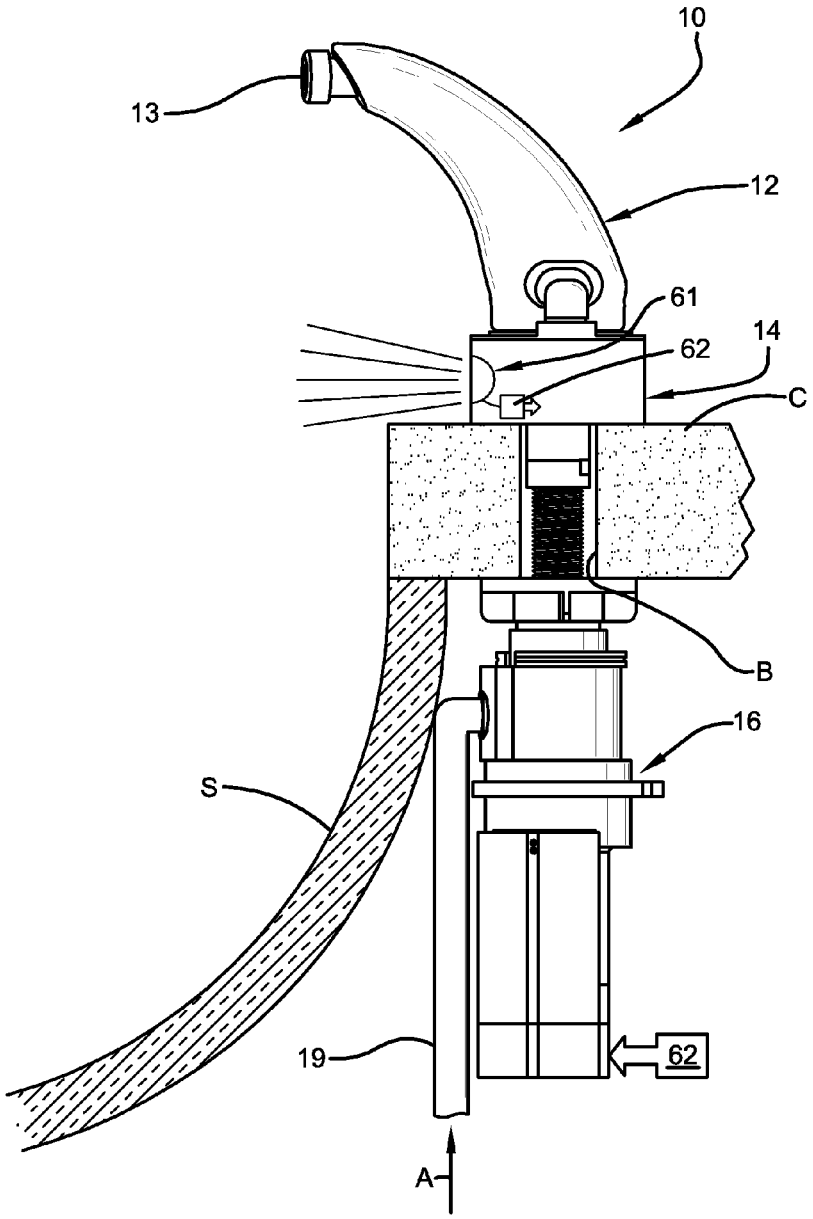
FIG. 1 is a side elevation view of a dispenser in accordance with this invention, the dispenser employing a sensor driven control rod.

The present invention provides novel concepts for actuating dispensers. The present invention has particular utility in sink-side soap dispensers and, even more particularly, in sink-side soap dispensers that dispense soap as a foam. Although of particular use in such an environment, it will be readily appreciated that the present invention has a very wide range of applications, and the concepts taught herein may be employed to dispense various products in various environments.

One of the main focuses herein is to teach in this disclosure the general concepts necessary to provide a dispenser that employs a concentrated product and dilutes and dispenses that product by employing water from a pressurized water source. The pressurized water source both drives the pump mechanisms to advance the product to a dispensing outlet and provides the water necessary to dilute the concentrated product. In particular embodiments, the pressurized water source is an established flowing water source, such as a public water supply system. The pressure of the flowing water is beneficially used to drive much of the dispensing components, reducing the need for the input of energy from batteries or a mains power supply or the like. Thus, in embodiments tapping into an already existing pressurized water supply, much of the power for driving the dispenser is provided by tapping into the potential energy of that water supply.

Specific structures are shown herein, but, from the disclosure herein, it will be apparent that, in its broadest sense, the present invention provides: a dispenser for dispensing a diluted form of a concentrated product, the dispenser comprising: a supply of concentrated product; a dilution chamber; a product pump mechanism including: a product chamber that fluidly communicates with said supply of concentrated product and fluidly communicates with said dilution chamber; a piston assembly having a product piston reciprocally received in said product chamber said product piston being biased toward a rest position; a water staging chamber; and an actuation assembly having a rest state, a staging state and a return state, said actuation assembly receiving water under pressure from a pressurized water supply, wherein, in said staging state, water from said pressurized water supply is fed to said water staging chamber, increasing the volume thereof and causing the actuating of said pump mechanism by moving said product piston to decrease the volume of said product chamber and drive a dose of product into said dilution chamber, and, in said return state, (a) water within said water staging chamber exits said water staging chamber, (b) water is advanced to said dilution chamber and mixes with said dose of product to create diluted product, and (c) said product chamber increases in volume and draws a dose of product from said supply of concentrated product into said product chamber.

In a specific embodiment, the dispenser employs a refill unit, and, while a specific structure is shown for a particular refill unit, it will be appreciated from the disclosure herein that, in its broadest sense, the present invention also provides a refill unit including a supply of concentrated product; a dilution chamber having an inlet for said concentrated product and an inlet for water; a product pump mechanism, said pump including: a product chamber that fluidly communicates with said supply of concentrated product and fluidly communicates with said dilution chamber, said product chamber structured to decrease in volume upon actuation of said product pump mechanism to thereby drive a dose of product from said product chamber toward said dilution chamber, said product chamber further structured to increase in volume after actuation of said product pump mechanism to thereby draw a dose of product from said supply of concentrated product into said product chamber.

Various embodiments are disclosed herein. A first, sensor-activated embodiment is shown in FIG. 1. From FIG. 1, it can be seen that a dispenser 10 in accordance with this invention includes a countertop housing assembly 12, a through-counter interface 14 and an actuation mechanism 16.

For reasons of style and utility, the countertop housing assembly 12 may be formed to look like a faucet, as shown, but it may take other forms, as desired, to present a dispenser outlet 13 where product is dispensed upon actuation of the dispenser 10. In this particular embodiment, the countertop housing assembly 12 may be provided on top of a counter C, presenting the outlet 13 over a sink basin S, but, again, other forms and locations may be adopted for the countertop housing assembly 12.

The countertop housing assembly 12 is connected to a through-counter interface 14. In this embodiment, the through-counter interface 14 provides the pathway for the pressurized water source to actuate pump mechanisms, but it will be appreciated that the pump mechanisms could be provide below the counter with the through-counter interface 14 providing a pathway for diluted product created upon actuation of the pump mechanisms. Regardless of the position of components, the through-counter interface 14 provides connection between the countertop housing assembly 12 and the actuation mechanism 16 provided under the counter.

Figure 2:
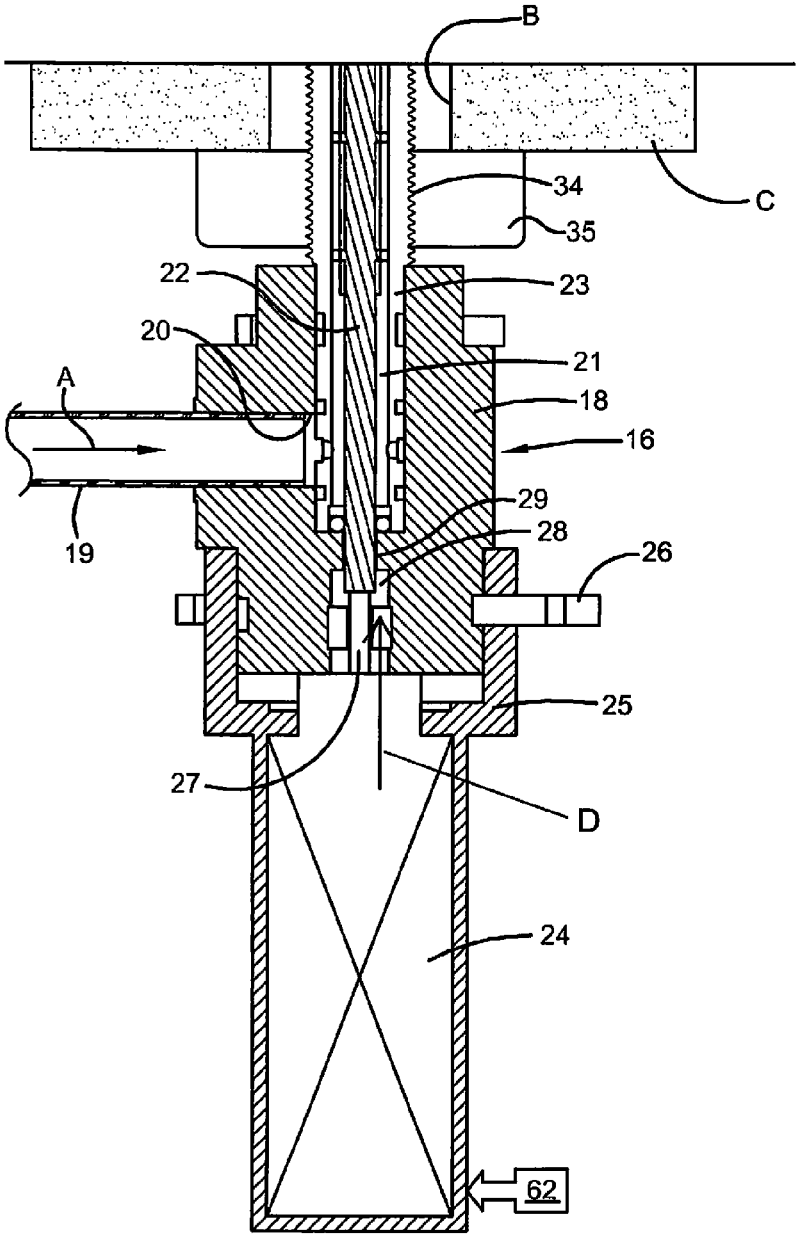
FIG. 2 is a side cross-sectional view of portions of the actuation mechanism and through counter interface for the dispenser of FIG. 1.
Figure 3:
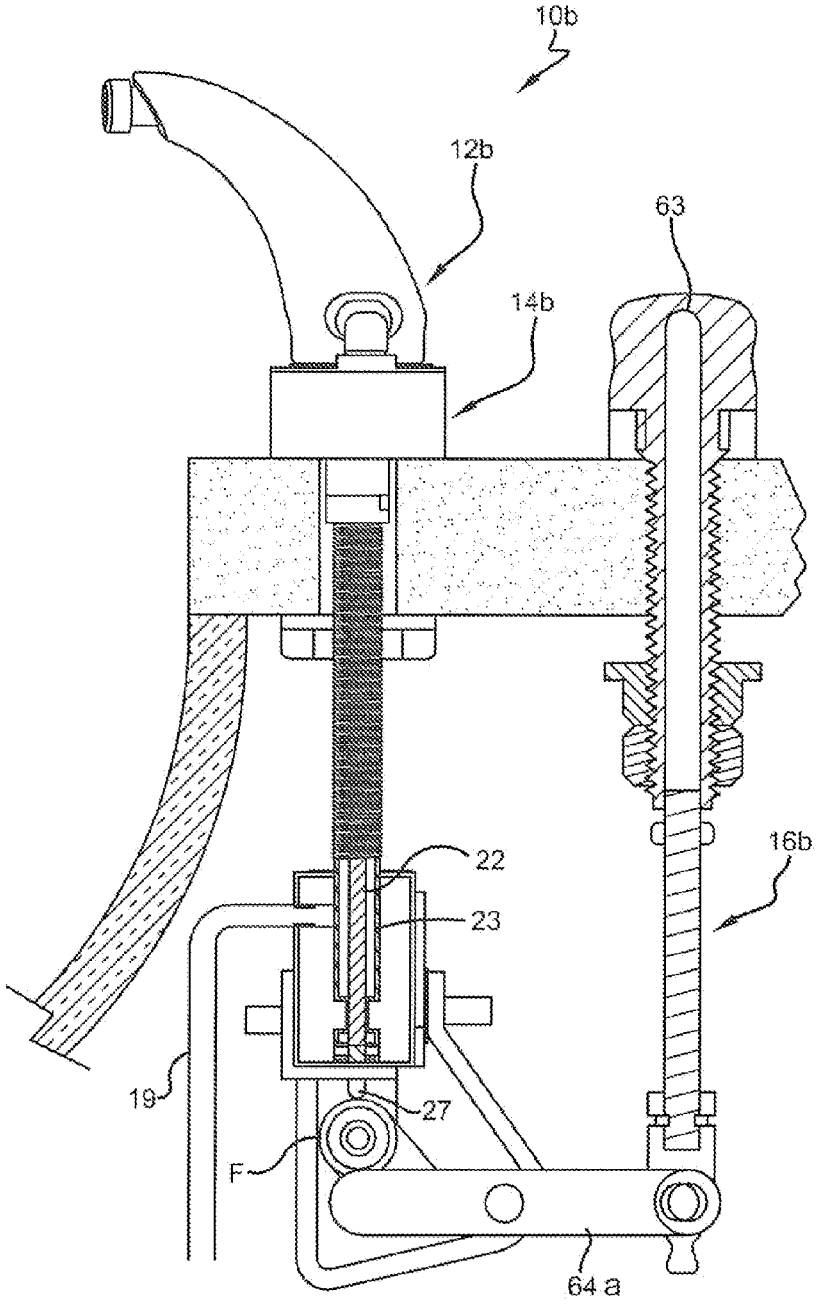
FIG. 3 is a side elevation view of a dispenser in accordance with this invention, the dispenser employing a manually driven control rod.

In the disclosure herein, three actuation mechanisms are envisioned. One actuation mechanism is shown in FIGS. 1 and 2 and includes a sensor-driven control rod that is acted upon by a primary drive mechanism such as a solenoid or gearbox or eccentric. A second actuation mechanism is shown in FIG. 3 and includes a manually driven control rod that is acted upon by a primary drive mechanism that is manipulated manually by the individual using the dispenser. In a third actuation mechanism shown in FIG. 4, a valved manifold is employed. In each embodiment, the components necessary for initiating of the actuation of the dispenser are above the counter C. In the sensor-driven control rod embodiments (e.g., FIG. 1), a sensor is provided above the counter to sense the presence of a user's hands at the dispensing location under the outlet 13, and, upon sensing the user's hands, a signal is sent to actuation elements (eg. solenoid, gearbox, eccentric) to cause an actuation of the dispenser 10. Such a sensor is also employed in the valved manifold embodiment shown in FIG. 4 and designated by the numeral 10*c*. In the embodiment wherein the control rod is actuated manually by the user, a plunger or slide or push bar is provided above the counter to be manipulated by the user, the manipulation thereof resulting in actuation of the dispenser. This manually-actuated embodiment is shown generally in FIG. 3 and designated by the numeral 10*b*.

As already disclosed, the dispensers in accordance with this invention have a few major features. First, the pump mechanisms that advance product to be dispensed are driven by a pressurized water source. Second, the dispensers employ a concentrated product that is diluted before dispensing, thus resulting in a realization of increased dispensing doses per unit volume of product held by the dispenser. This also permits the dispensing of more unit doses per volume of shipped product, thus requiring less resources to ship product to end consumers. The dispensers in accordance with this invention also beneficially employ the pressurized water source by employing that water source in diluting the concentrated product. Because a pressurized water source drives the dispensing in a manner heretofore not contemplated in the prior art, the various actuation mechanisms and how they feed water to the appropriate area of the dispenser are first disclosed. It is believed this will be an efficient way to disclose the present invention because the structures driven by each alternate actuation mechanism are the same and they need only be disclosed once after disclosure of the various actuation mechanisms. With respect to the various actuation mechanisms, the above-mentioned embodiments employing a control rod are first disclosed. Of those embodiments, the sensor driven control rod is a subject of the disclosure directly below, with disclosure of the manually drive control rod to follow.

With reference to FIG. 2, an embodiment for a sensor-driven actuation mechanism 16 is shown to include a tee fitting 18 receiving a feed water pipe 19 in and inlet passage 20 thereof, the feed water pipe providing water under pressure and flowing in the direction of arrow A. The water fed by the feed water pipe 19 will likely most often be water provided from a public water system, and will therefore be under standard pressures (typically 20 to 120 psi) employed by the public water system. Of course, the water might also be provided by a private water supply or otherwise. In accordance with this invention, the water must be pressurized so that, when the actuation mechanism 16 is operated to actuate the dispenser 10 the pressurized water serves to actuate pump mechanisms and cause the dispensing of product. Thus, the term "pressurized water source" should be interpreted extremely broadly, though, in particular embodiments, the pressurized water source is an established flowing water source, such as a public water supply system. The water is fed through feed water pipe 19 to an outlet passage 21 of the tee fitting that intersects with the inlet passage 20. A piston extension 22 is received in this outlet passage 21. More particularly, the piston extension 22 is received interiorly of a drive-water sleeve 23 that fits intimately within the outlet passage 21, contacting the sidewalls of the tee fitting 18 that defines the outlet passage 21. In this embodiment, the drive-water sleeve 23 and the piston extension 22 therein extend upwardly through the counter C at a through bore B. Further structures of the drive-water sleeve 23 and piston extension 22 will be disclosed more fully below, but the remainder of some of the below-counter elements of the actuation mechanism 16 is first disclosed.

A primary drive mechanism 24 is secured to the tee fitting 18 by means of a housing 25 keyed to the tee fitting 18 as at key 26. This primary drive mechanism 24 may be a solenoid or gearbox or eccentric mechanism suitable for reciprocally moving a drive piston 27. The drive piston 27 extends exteriorly of the housing 25 to extend into a sealed chamber 28 of the tee fitting 18. Piston extension 22 extends into the sealed chamber 28 through a sealed neck 29, which is sealed by way of an O-ring (shown but not numbered). The primary drive mechanism 24, when activated, moves the drive piston 27 upwardly in the direction of arrow D, thereby also moving the piston extension 22 upwardly in the drive water sleeve 23.

Figure 5:
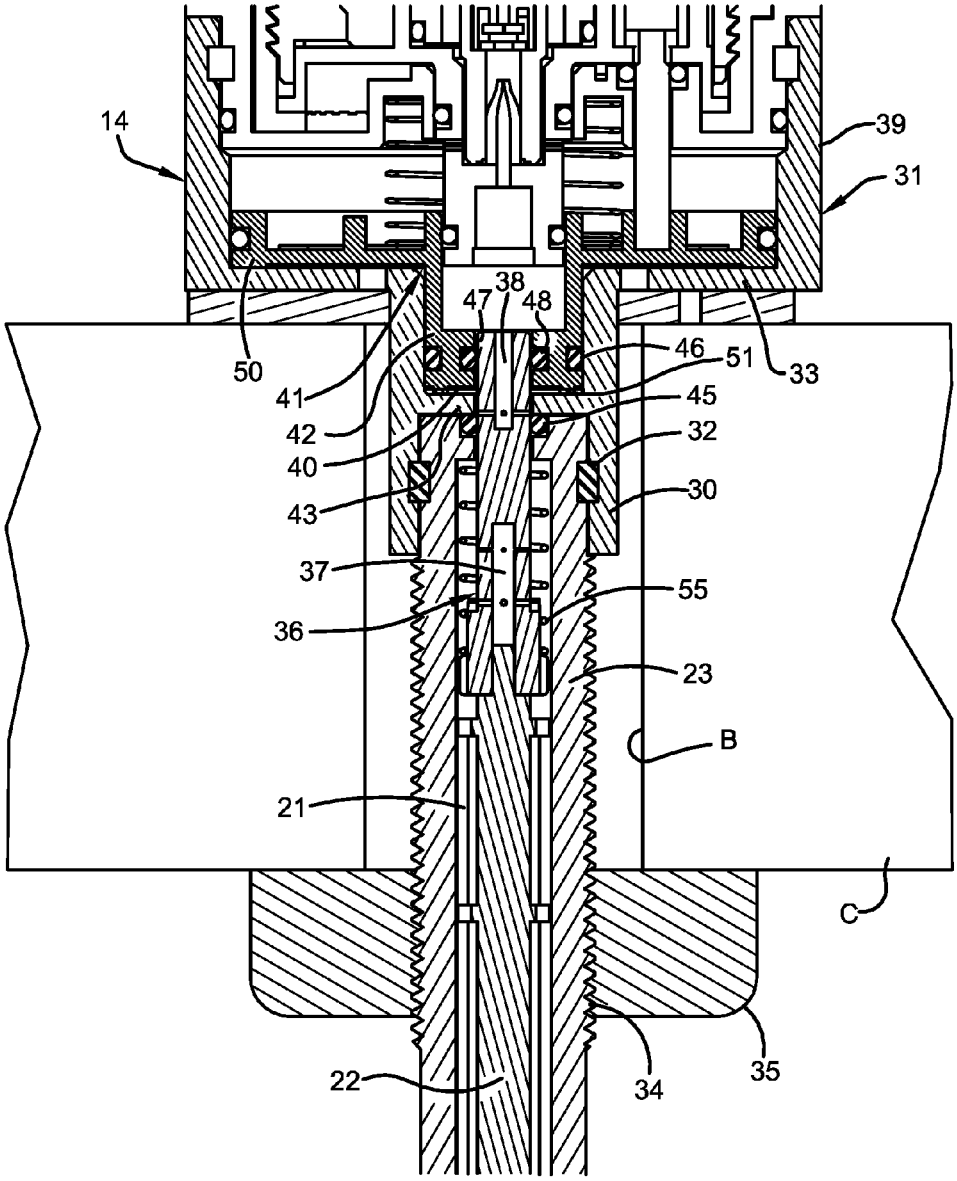
FIG. 5 is a side elevation cross-sectional view of portions of the actuation mechanism, the through counter interface and portions of the pump mechanisms of the dispensers of FIGS. 1, 2 and 3, wherein the dispenser is in a rest state.

The bottom portion of the drive water sleeve 23 is secured to the tee fitting 18, and, as seen in FIG. 5, the upper end thereof is keyed to an axial extension 30 of a base support member 31, as shown at the key 32. The axial extension 30 of the base support member 31 extends partly into the bore B of the counter C and extends downwardly from a radially extending base 33 that extends beyond the bore B so the through counter interface 14 (i.e., drive water sleeve 23 and base support member 31) may be supported by resting on the top of the counter C. It will be appreciated that the base support member 31 and the drive water sleeve 23 secured thereto can be dropped down through the bore B and, thereafter, the tee fitting 18 and primary drive mechanism 24 and associated piston extension 22 can be secured thererto. The drive water sleeve 23 includes an exteriorly threaded portion 34 onto which a nut 35 may be threaded to securely mount the through-counter interface 14 to the counter by securing the counter tightly between the nut 35 and the base 33.

The upper end of the piston extension 22 (i.e., the end opposite the end that interacts with the drive piston 27) interacts with a control rod 36 having a staging chamber inlet passage 37 and a staging chamber outlet passage 38. The piston extension 22 may be connected to the control rod 36 or may be unitary therewith or may at least contact it to move it upwardly when the primary drive mechanism 24 is activated. The staging chamber inlet passage 37 is so named because, in a particular stage of the dispensing cycle, the staging chamber inlet passage 37 defines a fluid passage permitting the water in the drive water sleeve 23 to travel to a staging chamber 40 (FIGS. 5-8). Similarly, the staging chamber outlet passage 38 is so named because, in a particular stage of the dispensing cycle, it serves to provide a fluid passage for water to exit the staging chamber 40 and flow into other portions of the dispenser.

The base support member 31 includes a sidewall 39 extending upwardly off of the distal ends of the base 33. A piston assembly 41 fits within the base support member 31. The axial extension 30 of the base support member 31 includes a radial inner wall 43 that defines a piston passage 44 through which the control rod 36 extends. An O-ring 45 seals the passage so that the water under pressure in the drive water sleeve 23 cannot enter the base support member 31 above the piston passage 44. An axial extension 42 of the piston assembly 41 fits intimately within the portion of axial extension 30 above the radial wall 43 and is sealed thereto by means of an O-ring 46. The axial extension of 42 also provides a piston passage 47 through which the control rod 36 extends. An O-ring 48 also seals this piston passage 47 by contacting the exterior of the control rod 36.

The staging chamber 40 is defined between the bottom surface 49 (FIG. 7) of the axial extension 42 and the top surface of the radial wall 43. As can be seen, a small gap is provided between the surfaces when the dispenser is in a rest state, as in FIG. 5. In this embodiment, the distance between the surfaces is a result of the base plate 50 of the piston assembly resting on the top surface of the base 33 and the matching of the length of the axial extension 42 to that portion of axial extension 30 above radial wall 43. The gap is further reinforced by the use of feet 51 at the bottom of axial extension 42.

The structure thus far disclosed is sufficient for explaining how the control rod-based actuation mechanisms of this invention advantageously employ pressurized water systems in order to drive pump mechanisms to dispense a product. The pump mechanisms herein rely upon reciprocal movement of piston members, and, therefore, it is initially sufficient to disclose how a piston member, namely piston assembly 41, is reciprocally moved by actuation of the dispenser, and, thereafter the pump mechanisms will be explained so that it may be appreciated how the reciprocal movement of the piston assembly 41 results in the dispensing of product.

Figure 6:
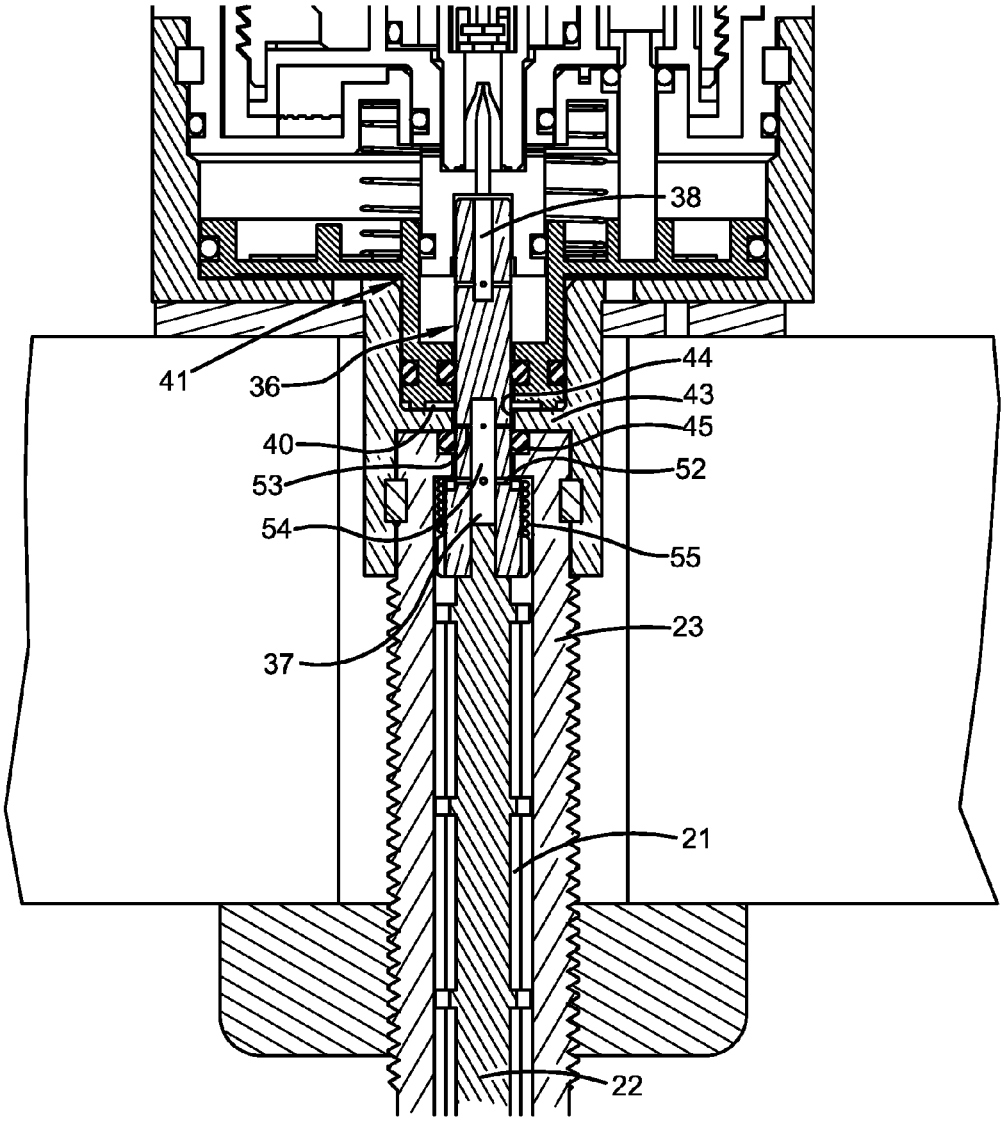
FIG. 6 is a side elevation cross-sectional view as in FIG. 5, but with the dispenser in an initial configuration of a staging state.

FIG. 5 shows the dispenser 10 in a rest state. The control rod 36 is held in a down position, and the staging chamber inlet passage 37 resides within the drive water sleeve 23. The body of the control rod 36, at O-ring 45, blocks the passage of water from within the drive-water sleeve 23 into the staging chamber 40. FIG. 6 shows the dispenser after the primary drive mechanism 24 moves the drive piston 27 upwardly (FIG. 2) and thereby also moves the piston extension 22 and the control rod 26 upwardly in the direction of arrow D to place the dispenser in the intial stages of what is termed herein a staging state. In this state, shown in FIG. 6, the staging chamber inlet passage 37 provides fluid communication between the staging chamber 40 and the water under pressure within the drive-water sleeve 23. More particularly, the staging chamber inlet passage 37 includes radial inlet passages 52 and radial outlet passages 53 joined by an axial passage 54. When the dispenser is in the staging state, the radial inlet passages 52 communicate with the water in the drive water piston 23, while the radial outlet passages 53 extend above the O-ring 45 to fluidly communicate with the staging chamber 40. Thus, the water under pressure in the drive water piston 23 can flow through the staging chamber inlet passage 37 to enter the staging chamber 40.

Figure 7:
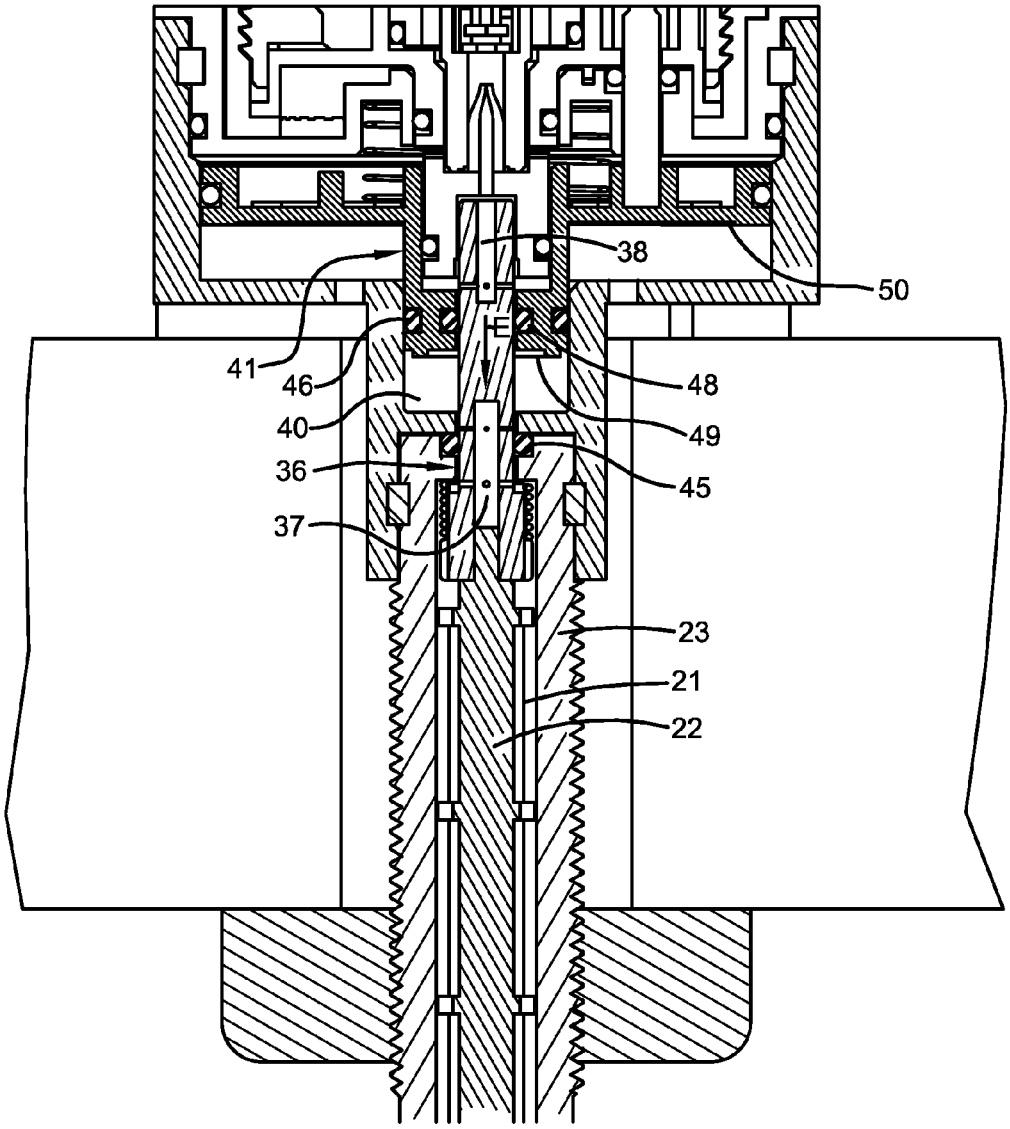
FIG. 7 is a side elevation cross-sectional view as in FIG. 5, but with the dispenser in an later configuration of a staging state.

With reference to FIG. 7, a later staging state of the dispenser is shown after water has flown into the staging chamber 40, causing it to increase in volume by pressing up on the bottom surface 49 of the piston assembly 41. As can be seen in FIG. 7, the piston assembly 41 is limited in its amount of travel, and the staging chamber 40 has a defined maximum volume, the staging chamber 40 being sealed by O-rings 45, 46 and 48 at all volumes thereof. When this maximum volume is reached, the system will remain in this filled staging state until such time as the control rod 36 is drawn downward in the direction of arrow E in what is termed herein the return state of the dispenser.

The control rod 36 may be moved in the direction of arrow E in any suitable manner. In the present embodiments, the force driving the primary drive piston 27 is removed, and a piston return spring 55 acting on the control rod 36 in the drive water sleeve 23 moves the control rod 36 and other associated elements downwardly in the direction of arrow E. In this sensor-driven embodiment, the force driving the primary drive piston 27 is the primary drive member 24, and it is configured to draw the primary drive piston 27 down after a time suitable for ensuring the staging chamber 40 has substantially been filled in the staging state. The control rod 36 moves downwardly under the influence of piston return spring 55, however, it will be appreciated that the primary drive piston 27 could be keyed to the piston extension 22 to draw piston extension 22 and the control rod 36 downwardly without use of a return spring.

Figure 8:
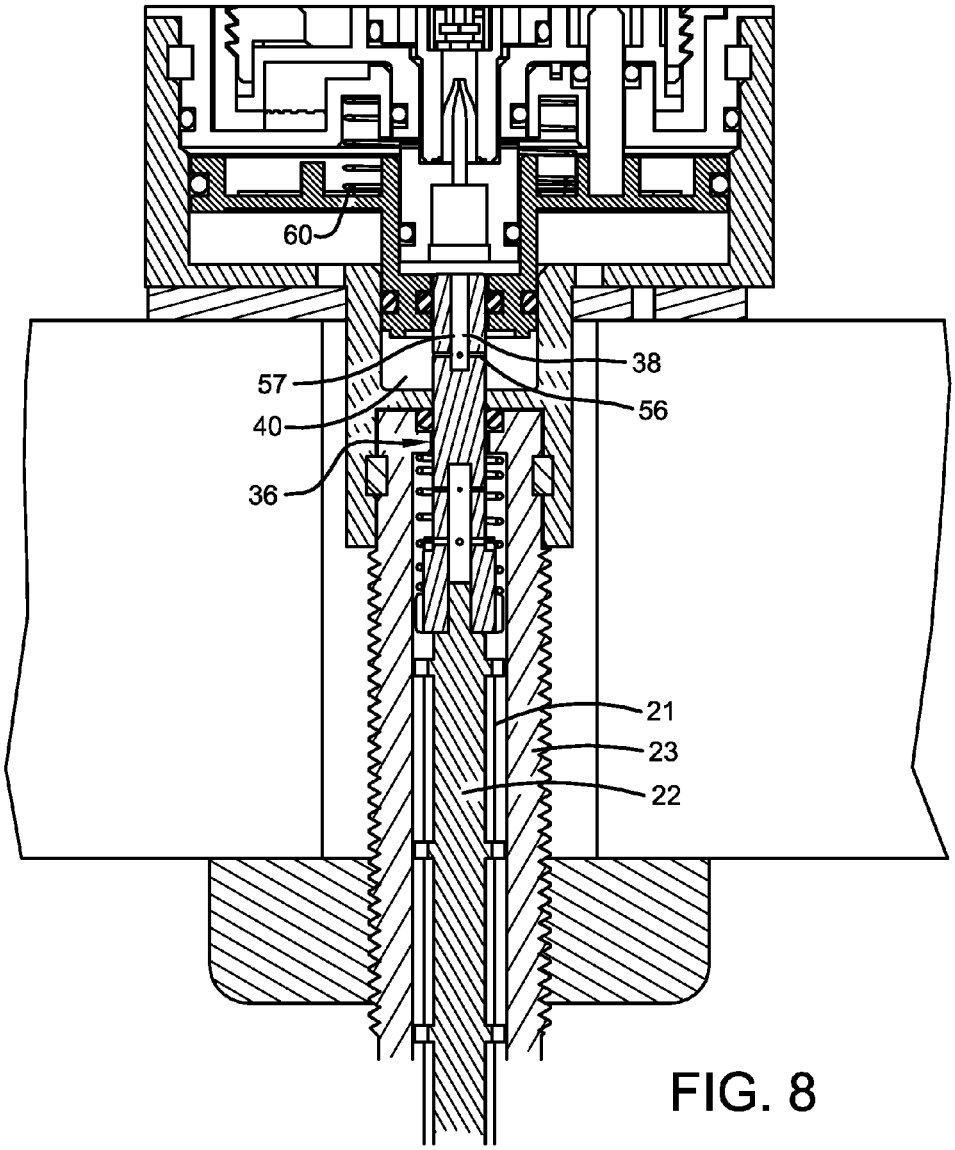
FIG. 8 is a side elevation cross-sectional view as in FIG. 5, but with the dispenser in an initial configuration of a return state.

As seen in FIG. 8, which shows an initial stage of the return state, the staging chamber outlet passage 38 fluidly communicates with the water in the staging chamber 40, permitting the water to enter the staging chamber outlet passage 38 at radial inlets 56 and exit the axial passage 57 to travel to the remainder of the dispensing system as will be described more fully below. For now, it is sufficient to note that the piston assembly 41 can now move downwardly under the influence of a piston assembly return spring 60 to move back to the rest state, as the water in the staging chamber 40 is forced into and through the staging chamber outlet passage 38. Thus it should now be appreciated that movement of the control rod 36 results in the water supply driving the piston assembly 41 to move upwardly and downwardly in a reciprocal manner from a rest state, through a staging state and a return state, back to the rest state. As the staging chamber 40 fills, the piston assembly 41 moves upwardly and, when the control rod 36 is moved downwardly to permit the release of water from the staging chamber 40, the piston assembly 41 moves downwardly under the action of a piston assembly return spring 60. The water released from the staging chamber 40 advances toward the remainder of the system, toward the dispenser outlet 13.

In the particular embodiment of FIG. 1, the dispenser 10 includes a sensor 61 that senses the presence of a user's hand below the outlet 13 and sends a signal to the primary drive mechanism 24, as represented at 62. The signal results in movement of the drive piston 27 to enter the staging state. As already mentioned, the primary drive mechanism 24 may be a gearbox, solenoid or eccentric-based drive member, or indeed, any suitable drive member for driving the control rod 36 upwardly upon receiving an actuation signal.

With reference to FIG. 3 and dispenser 10*b*, it can be seen that this movement of the control rod 36 might instead be accomplished manually. The dispenser 10*b* includes a housing assembly 12*b* and a through-counter interface 14*b* that are substantially identical to those of the embodiment of FIG. 1. The actuation mechanism 16*b* is a manually actuated mechanism instead of an automated mechanism such as the sensor-driven gearbox, solenoid or eccentric-based drive member just described. The actuation mechanism 16*b* communicates with a tee-fitting 18, receiving a feed pipe 19 and a drive-water sleeve 23 and a piston extension 22, substantially as in the embodiments of FIGS. 2 and 5-8, the piston extension 22 interacting with a control rod (not shown) substantially like that of FIGS. 5-8. In the embodiment of dispenser 10*b*, the actuation mechanism 16*c* includes an above-counter plunger 63 for actuating the dispenser. In this embodiment, the user presses downwardly on the above-counter plunger 63, and, through a pivoting connector 64*a* and roller follower F or other suitable assembly, this downward plunger movement is translated into upward movement of the drive piston 27 and thereby piston extension 22 a control rod 36 (not shown in FIG. 3, but substantially as shown in FIGS. 5-8) in accordance with what has already been taught herein. Thus, in the manually actuated dispenser of FIG. 3, the actuation assembly includes a manually-driven plunger that is operatively connected to the control rod such that manually pressing the plunger moves the control rod to the staging state. Release of the plunger allows the control rod to return to the rest state. This causes appropriate reciprocal movement of the piston assembly 41. The remaining structures of the embodiment of FIG. 3 are otherwise identical to that of FIGS. 1, 2, 5-8 and 12-18, which will be more apparent from the disclosures below.

Figure 4:
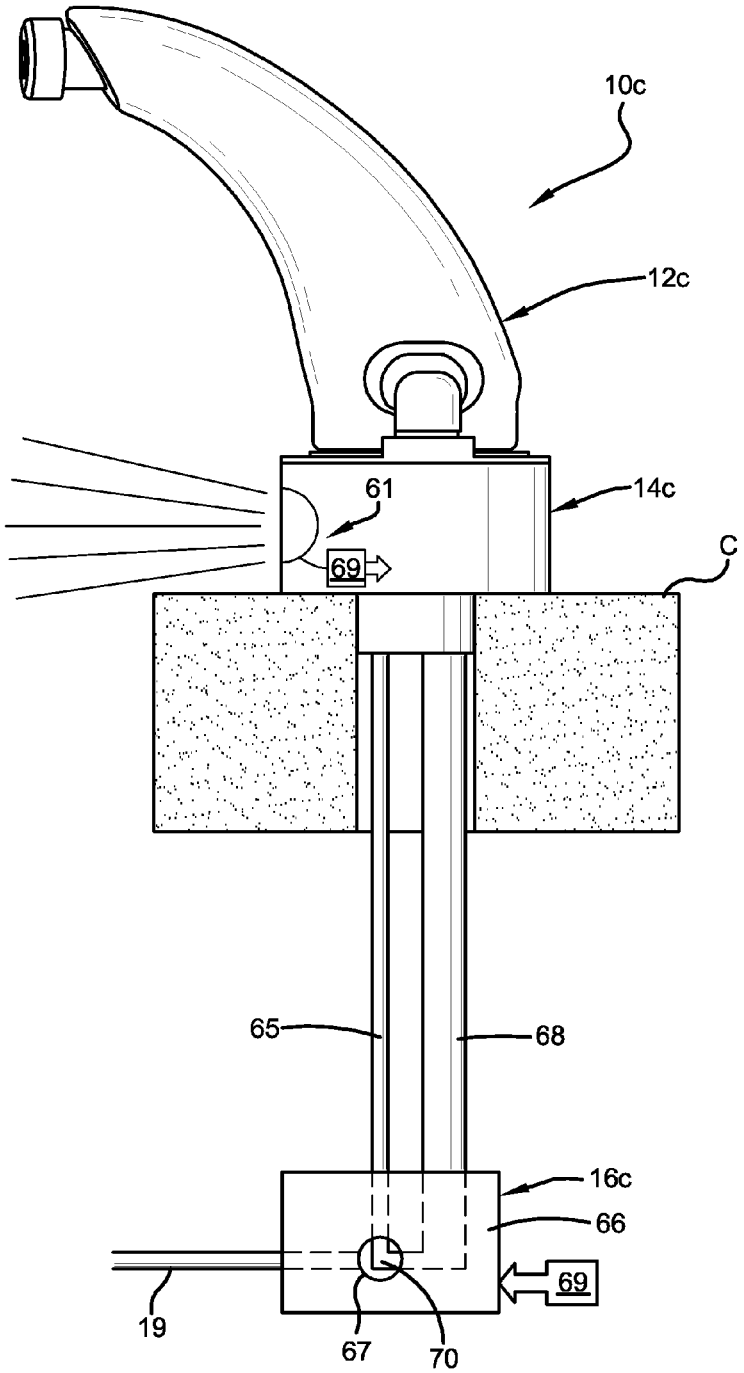
FIG. 4 is a side elevation view of a dispenser in accordance with this invention, the dispenser employing a valved manifold.
Figure 9:
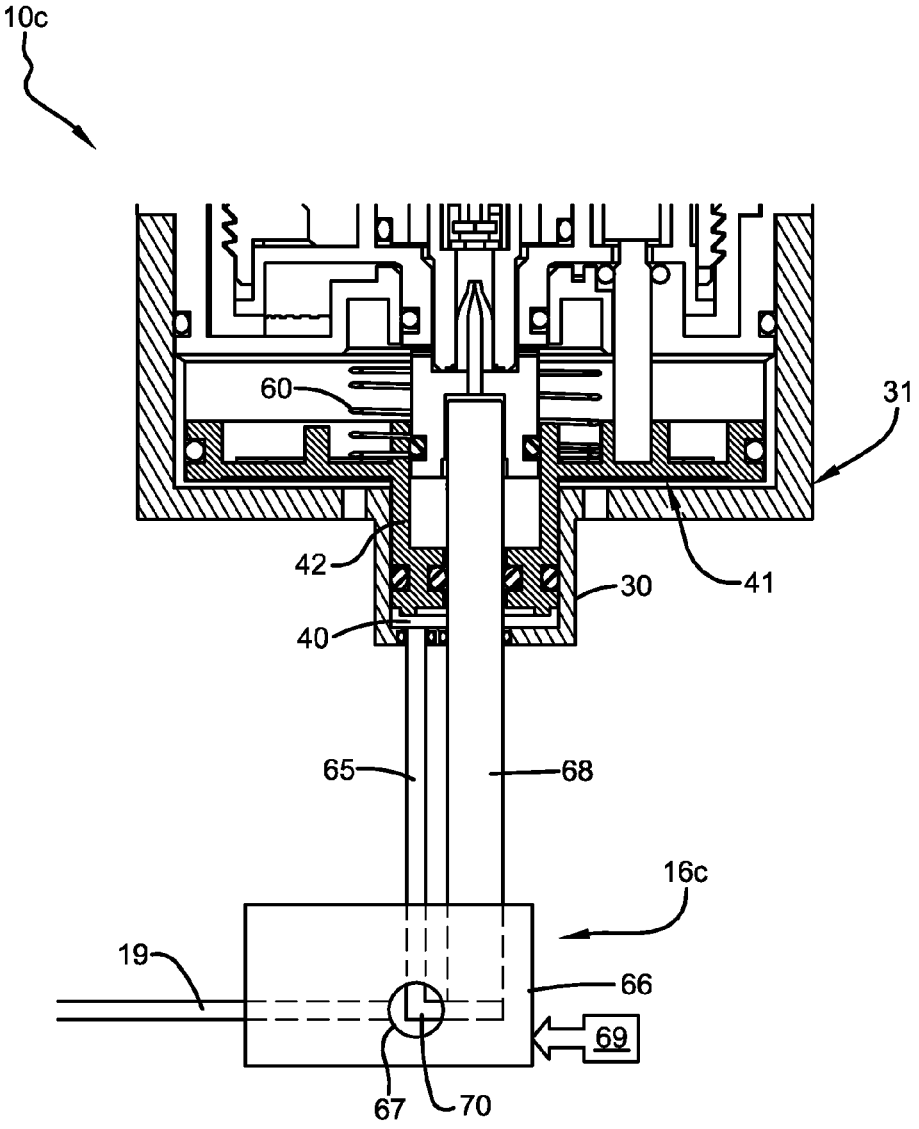
FIG. 9 is side elevation cross-sectional view of portions of the actuation mechanism, the through-counter interface and portions of the pump mechanisms of the dispenser of FIG. 4, wherein the dispenser is in a rest state.

In the valved manifold embodiment of FIG. 4, the dispenser 10*c* does not employ a control rod, but instead directly feeds water to the staging chamber 40 and advances water from the staging chamber 40 to the remainder of the system through use of the valved manifold and associated conduits. The dispenser 10*c* includes a housing assembly 12*c* that is substantially identical to the housing assemblies 12*a* and 12*b* of the other embodiments. The through-counter interface 14*c* is slightly different in that it does not include the control rod and drive water sleeve, but it does provide the staging chamber 40 and appropriate means to achieve reciprocal movement of the piston assembly 41, as will be described more fully below with reference to FIGS. 9-11. In this embodiment, the actuation mechanism 16*c* is provided by a valved manifold 66 and a staging conduit 65 and transfer conduit 68, and the valved manifold operates to achieve the rest state, staging state and return state. FIG. 9 shows the dispenser 10*c* in a rest state. The staging chamber 40 is still provided by an axial extension 30 of a base support member 31 and a bottom surface 49 of an axial extension 42 of a piston assembly 41, but the water is fed into and bled from the staging chamber 40 by communication with a staging conduit 65 extending from a valve manifold 66. The valved manifold 66 receives water under pressure from a feed water pipe 19 and includes a feed valve 67 having an L-shaped passage 70 therethough. The feed valve 67 can be moved so that the L-shaped passage 70 provides either fluid communication between the feed water pipe 19 and the staging conduit 65 or between the staging conduit 65 and a transfer conduit 68.

Figure 10:
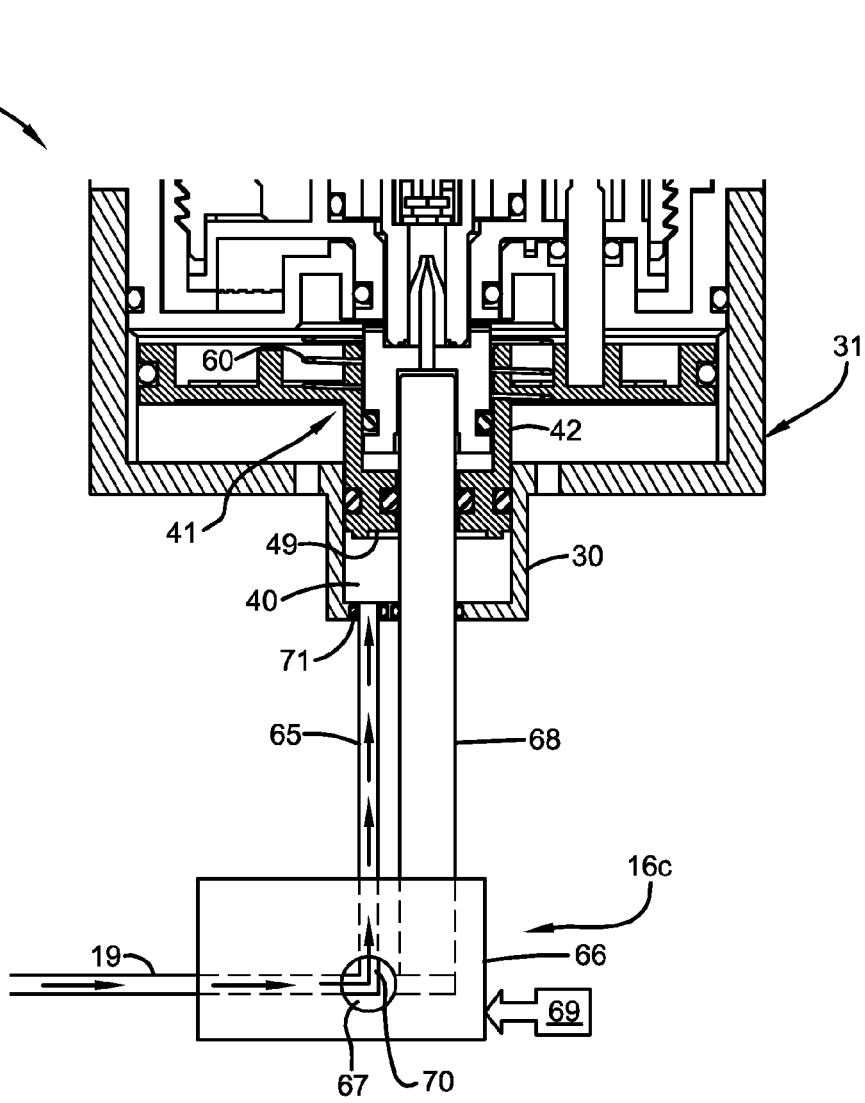
FIG. 10 is a side elevation cross-sectional view as in FIG. 9, but with the dispenser in a final configuration of a staging state.
Figure 11:
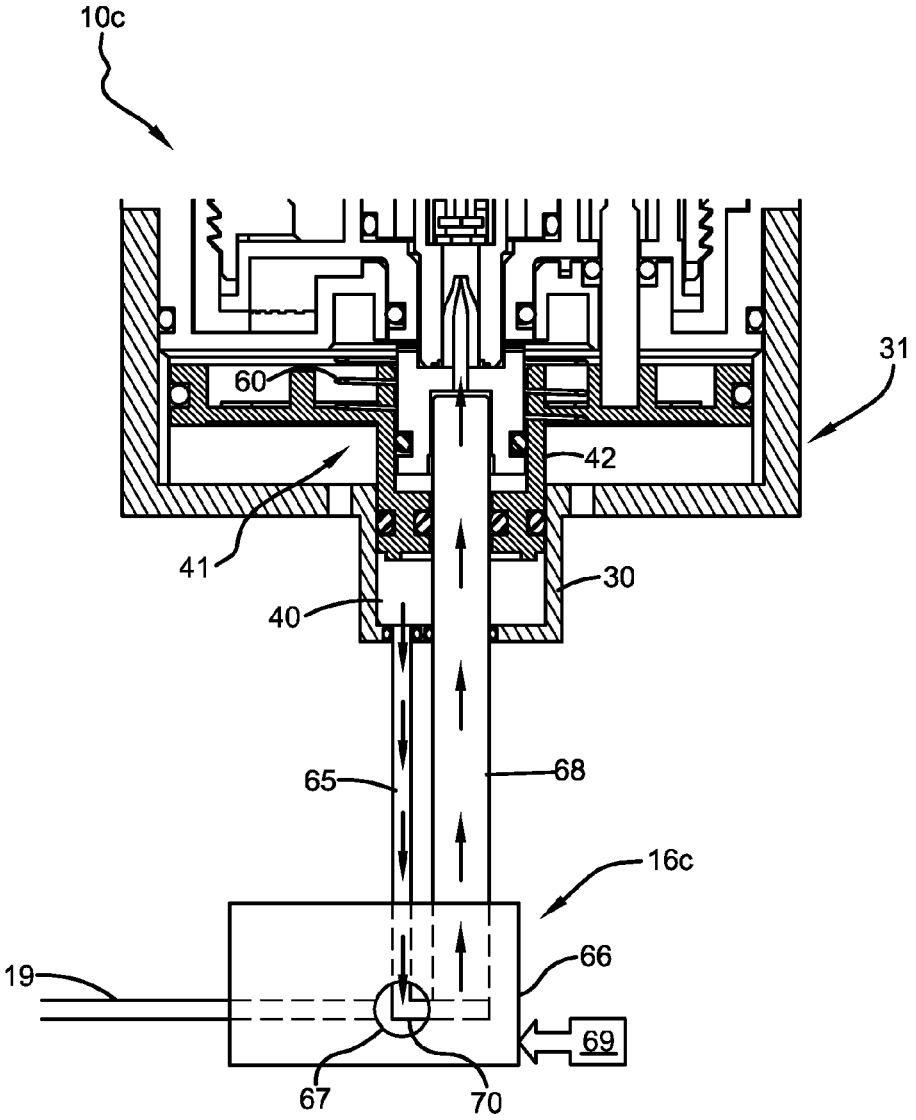
FIG. 11 is a side elevation cross-sectional view as in FIG. 5, but with the dispenser in an initial configuration of a return state.

In the rest state of the dispenser 10*c* shown in FIG. 9, the L-shaped passage 70 of the feed valve 67 is positioned so that staging conduit 65 fluidly communicates with the transfer conduit 68, and the water under pressure in the feed water pipe 19 cannot flow through the valved manifold 66 to the staging conduit 65 because there is no path open from the feed water pipe 19 to the staging conduit 65. Upon actuation of the dispenser 10*c*, the feed valve 67 in the valved manifold 66 is moved so that the L-shaped passage 70 provides fluid communication between the feed water pipe 19 and the staging conduit 65, thus entering the staging state and resulting in the filling of the staging chamber 40 as in FIG. 10 (water flow represented by multiple arrows). In the staging state, the water under pressure in the feed water pipe 19 can flow in the direction the arrows, through the L-shaped passage and the staging conduit 65, to fill the staging chamber 40. Just as in FIG. 7, this causes the staging chamber 40 to increase in volume by pressing up on the bottom surface 49 of the piston assembly 41. As can be seen in FIG. 10, the piston assembly 41 is limited in its amount of travel, and the staging chamber 40 has a defined maximum volume, the communication between the staging conduit 65 and the staging chamber 40 being sealed as at o-ring 71. When this maximum volume is reached, the system will remain in this filled staging state until such time as the return state of FIG. 11 is initiated by moving the feed valve 67 so that the L-shaped passage 70 provides communication between the staging conduit 65 and transfer conduit 68.

In the return state, water flows from the staging chamber 40 back into the staging conduit 65, as the staging chamber 40 decreases in volume under the influence of the piston assembly 41 and return spring 60. This forces a dose of water back toward the valved manifold 66, forcing water through the feed valve 67 and transfer conduit 68 toward and through the remainder of the dispensing system, as generally represented by the multiple arrows in FIG. 11 and as will be described more fully below. The communication of the transfer conduit 68 into the sealing chamber is sealed as at o-ring 72, and the communication through the piston assembly 41, particularly the axial extension 42 thereof, is sealed at o-ring 48 (similarly to the sealing of the control rod 36 (FIG. 5). For now, it is sufficient to note that the piston assembly 41 moves downwardly under the influence of the piston assembly return spring 60 to move back to the rest state, and the water in the staging chamber 40 is forced back into the staging conduit 65, and toward the remainder of the system. Thus it should now be appreciated that the manipulation of the feed valve 67 results in the water supply driving the piston assembly 41 to move upwardly and downwardly in a reciprocal manner from a rest state, through a staging state and through a return state, back to the rest state.

In a particular embodiment, the valved manifold 66 is a direct acting three-way valve, similar to a Parker Hannifin 7000 Series valve (Parker Hannifin, Cleveland, Ohio, USA). It will be appreciated, however, that the valved manifold is merely one structure suitable for providing the communication between a pressurized water source and a staging chamber and further providing communication between a staging chamber and the remainder of the dispensing system. Other structures, for example, employing multiple conduits and multiple valves might be employed.

In the particular embodiment of FIG. 4, the dispenser 10*c* includes a sensor 61 that senses the presence of a user's hand below the outlet 13 and sends a signal to mechanisms that control the movement of the feed valve 67, as represented at 69. The mechanisms generally represented at 69 can be electronics and appropriate signal receivers and control circuitry for moving the feed valve 67 to achieve the rest state, staging state and return state for operating the dispenser. The control circuitry can be configured to cause the feed valve 67 to move to permit flow to the staging chamber 40 for a short period of time sufficient to fill the staging chamber 40, and thereafter move to permit flow from the staging chamber 40 toward the remainder of the system. The remaining structures of the dispenser of FIG. 4 are substantailly identical to those of FIGS. 1 and 2. Having disclosed how the piston assembly 41 of the multiple embodiments is moved reciprocally by employing the staging chamber 40, the particular pump mechanisms of this invention are next disclosed in order to fully disclose how the present dispensers serve to dispense product. Again, the pump mechanisms are the same for each embodiment, so they are shown and described once.

The particularly preferred embodiment for the pump mechanisms herein is designed to dilute a concentrated product and mix that diluted product with air to dispense the product as a foam. However, as already mentioned above and as will be described herein below, this preferred embodiment may readily be adapted to simply dilute a concentrated product and dispense it as a liquid. As such, the dispensers of this invention are particularly suited for dispensing any flowable product. Personal care products are of particular interest, but the applications for the dispenser concepts herein may be much larger. In the area of personal care products, soaps and sanitizers are of particular interest.

Figure 15:
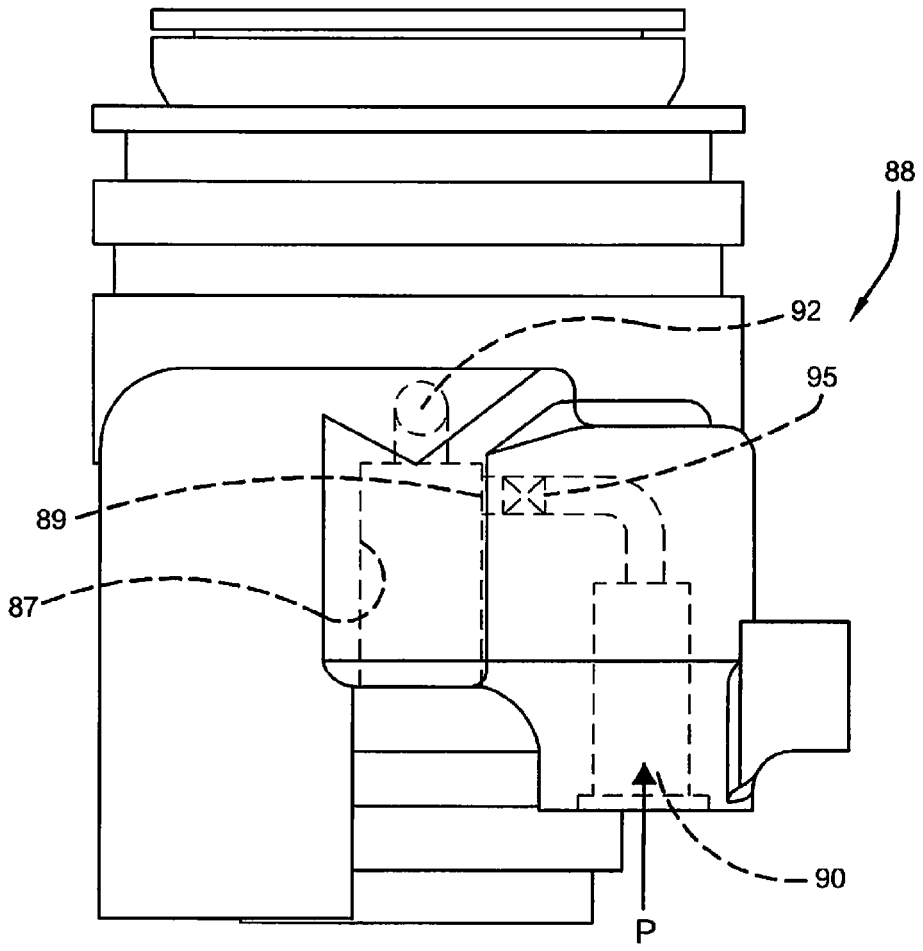
FIG. 15 is a right-side elevational view of the pump interface structure.

Having described various suitable structures and actuation mechanisms for effecting the reciprocal movement of the piston assembly 41 as a result of employing a pressurized water source and a staging chamber, this disclosure in next directed to the remainder of the system, particularly the pump mechanisms that are actuated upon the reciprocal movement of the piston assembly 41 in order to dispenser product. The dispensers 10, 10*b* and 10*c* taught herein include substantially identical housing assemblies 12, 12*b* and 12*c*. Elements of the housing assemblies 12, 12*b* and 12*c*, particularly pump mechanisms therein, are shown in greatest detail in FIGS. 12 and 12*a*. Because the housing assemblies for each dispenser 10, 10*b*, 10*c* are substantially identical, reference is made only to housing 12 in FIGS. 12 and 12*a*, though the disclosure applies to each of those embodiments. The housing assemblies 12 each include a housing 80 that extends from the base support member 31 and is secured thereto or formed unitary therewith. In the embodiment shown, the housing 80 is shaped like a faucet, though it may take any desired form. A product pump mechanism 81 is held inside of the housing 80 and the base support member 31 and communicates concentrated product held interiorly of the housing 80 and exteriorly of the pump mechanism 81. The product pump mechanism 81 also communicates with a dispensing tube 82 that extends though the housing 80 to the dispensing outlet 13. The product pump mechanism 81 includes a product chamber 83 defined by a plug housing 84 and a plug 85 received therein. Reciprocal movement of the plug 85 increases and decreases the volume of the product chamber 83, causing doses of concentrated product to be drawn into and expelled from the product chamber 83. The plug housing 84 and plug 85 might also be considered to be a piston housing and piston, which are commonly employed to pump fluids upon reciprocal movement of the piston in the piston housing. The product chamber 83 could alternatively be provided as a dome pump, which is a known pump structure including a base and a flexible dome defining a product chamber with appropriate inlet and outlet valves. The plug 85 is biased to the rest position shown in FIG. 12 by means of a spring 86. The plug housing 84 interfaces with a port 87 in a pump interface structure 88 and the interface is sealed by an O-ring (not numbered). The plug housing 84 includes an inlet 89 that, as seen in FIG. 15, communicates with the concentrated product P though an inlet passage 90. The product chamber 83 also communicates with an outlet 91 communicating with an outlet passage 92 in the pump interface structure 88. A dilution cartridge 93 is connected to the pump interface structure 88 at a port 94 in the pump interface structure 88.

A one-way inlet valve 95 (FIG. 15) is provided in inlet passage 90 or directly at inlet 89 of the product chamber 83. A one-way outlet valve 96 is provided within or (as shown) at the end of the outlet passage 92. The one-way outlet valve 96 is shown as a duckbill valve permitting flow of product into the dilution cartridge 93, but preventing flow in the opposite direction back toward and into the outlet passage 92. The duckbill valve is merely a convenient structure for the particular embodiment shown, and other valves would be suitable.

In this particular embodiment, a foaming cartridge 97 is secured to the pump interface structure 88, and, as will be described more fully below, receives diluted product and air flowing through the pump interface structure 88 to produce a foam product. The foaming cartridge 97 fits within a port 98 of the pump interface structure 88 and is sandwiched between the pump interface structure 88 and a dispensing tube interface 99. The dispensing tube interface 99 provides a port 100 to which the dispensing tube 82 attaches such that there is fluid communication between from the foaming cartridge 97 into the dispensing tube 82.

Figure 12:
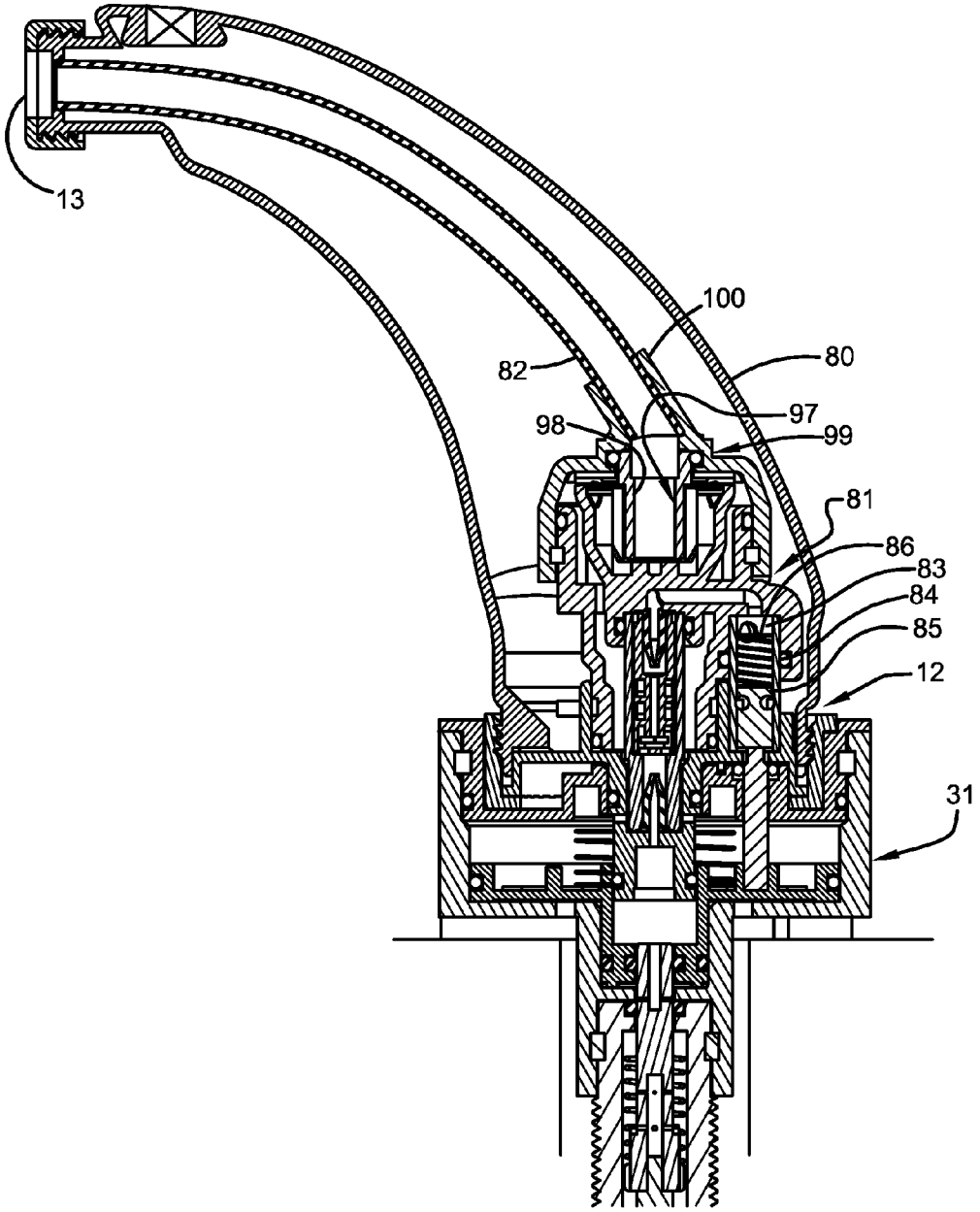
FIG. 12 is a side elevation cross-sectional view of the pump mechanisms held within the housing and through-counter interface the dispensers of FIGS. 1, 2 and 3, shown at an initial staging state.
Figure 12A:
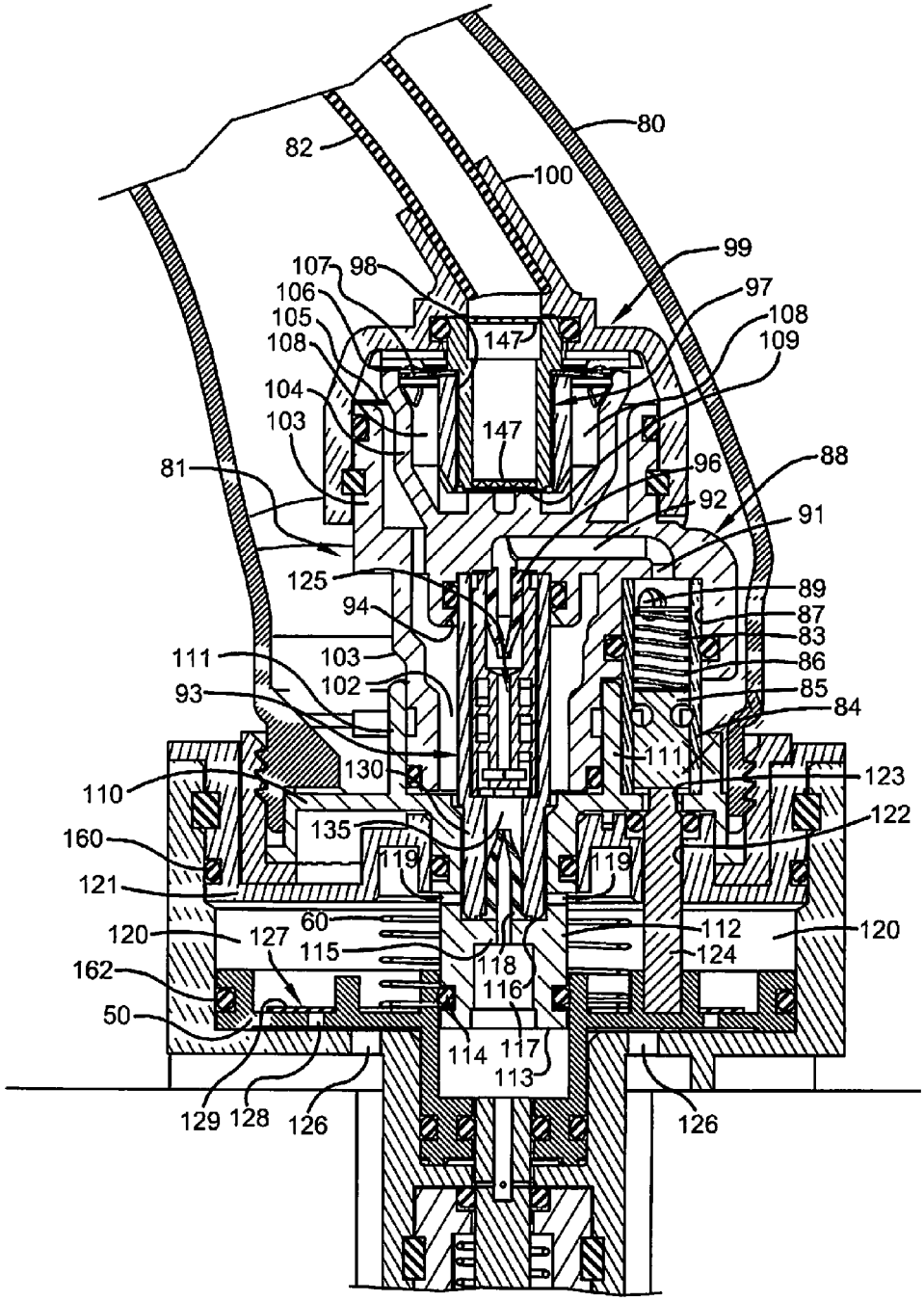
FIG. 12*a* is a side elevation cross-sectional view showing an enlarged section of the view of FIG. 12 in order to facilitate the viewing of numbered elements of the pump mechanisms and other portions of the dispenser.
Figure 18:
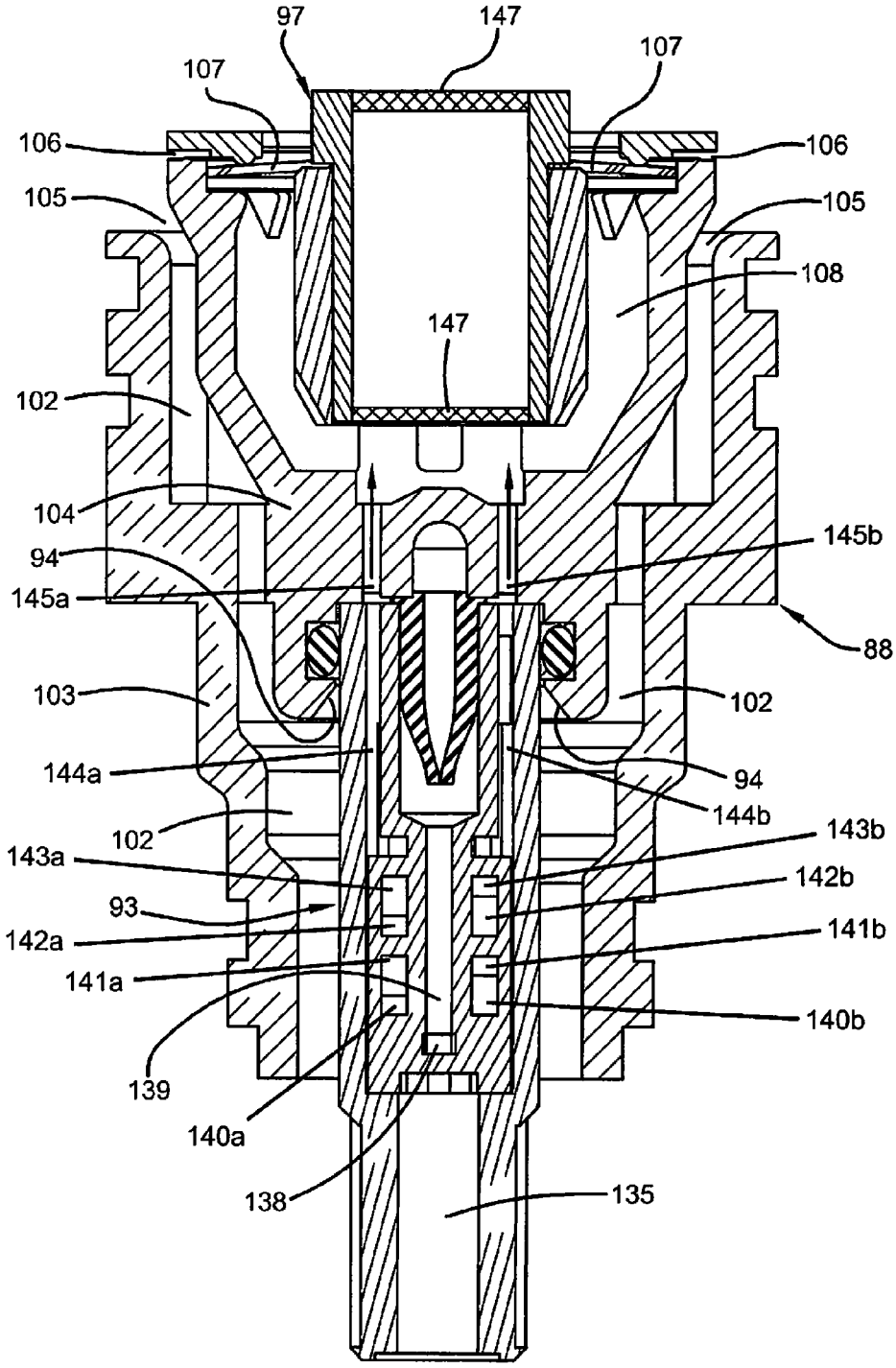
FIG. 18 is a right-side elevation cross-sectional view showing the interaction of the dilution cartridge with the pump interface structure.

As seen in FIGS. 12, 12*a* and 18, the pump interface structure 88 defines an air passage 102 that is defined interiorly of an exterior wall 103 at a lower portion of the pump interface structure 88 and exteriorly of both the dilution cartridge 93 and an internal wall 104 of an upper portion of the pump interface structure 88. As can be seen, the air passage 102 is an annular passage at the upper portion of the pump interface structure 88. The air passage 102 between an exterior wall 103 and interior wall 104 ends at an outlet 105, where the exterior wall 103 and interior wall 104 no longer overlap. Air is, however, retained inside the product pump mechanism 81 because the dispensing tube interface 99 extends over both the exterior wall 103 and interior wall 104 and is sealed to the pump interface structure 88. Thus, the air passage 102 continues through an aperture 106 in the interior wall 104 of the pump interface structure 88. A one-way inlet valve 107 regulates air flow through the aperture 106 into an annular space 108 surrounding the port 98 and inside of the interior wall 104. Air within this annular space 108 can reach the inlet 109 of the foaming cartridge 97.

The pump interface structure 88 is secured within the housing 80 by a retention plate member 110, which provides ribs 111 at appropriate locations to support the pump interface structure 88 and the housing 84. The retention plate member 110 includes an axial extension 112 extending to distal end 113 that, in the rest state of the piston assembly 41 extends into the interior tubular portion of the axial extension 41 and sealingly engages the interior surface thereof by means of an O-ring 114 or other appropriate seal. The axial extension 112 also includes a radial inner wall 115 serving as a rest for the distal end 116 of the dilution cartridge 93. As seen in FIG. 12, because the axial extension 112 and the axial extension 42 are both hollow, with the axial extension 112 extending into the axial extension 42, a dosing chamber 117 is defined between the axial extensions 112, 42. This dosing chamber 117 is separated from the interior of the dilution cartridge 93 by a dosing chamber outlet valve 118, such that the passage of the contents in the dosing chamber 117 into the interior of the dilution cartridge 93 is regulated by the dilution chamber outlet valve 118.

The axial extension 112 also includes air inlet apertures 119 that communicate with an air chamber 120 defined between the piston assembly 41 (particularly the base plate 50 thereof) and a mounting plate member 121. An o-ring 160 associated with the mounting plate member 121 and an o-ring 162 associated with the piston assembly 41 engage the sidewall 39 of the base support member 31 to provide a sealed air chamber 120. The mounting plate member 121 includes a piston aperture 122, which is aligned with a piston aperture 123 in the retention plate member 110. The piston apertures 122 and 123 are aligned with the plug 85 carried in the plug housing 84, and a primary piston 124 extends from the piston assembly 41 through both the piston apertures 122 and 123, to engage the plug 85. As already noted, a piston assembly return spring 60 urges the piston assembly 41 to the rest position shown in FIG. 12, and the spring 86 similarly urges the plug 85 downwardly as the primary piston 124 is drawn downwardly due to its being connected to or formed as part of the piston assembly 41.

It is briefly noted here that the mounting plate member 121 is employed in a particular embodiment of this invention that employs a refill unit. This refill unit will be described more fully below, but it should be appreciated that the retention plate member 110 could create the appropriate air chamber 120 by appropriately fitting or being formed as part of the base support member 31 to interact with the piston assembly 41. This will be better appreciated after a description of the functioning of the pump structures just described.

Figure 13:
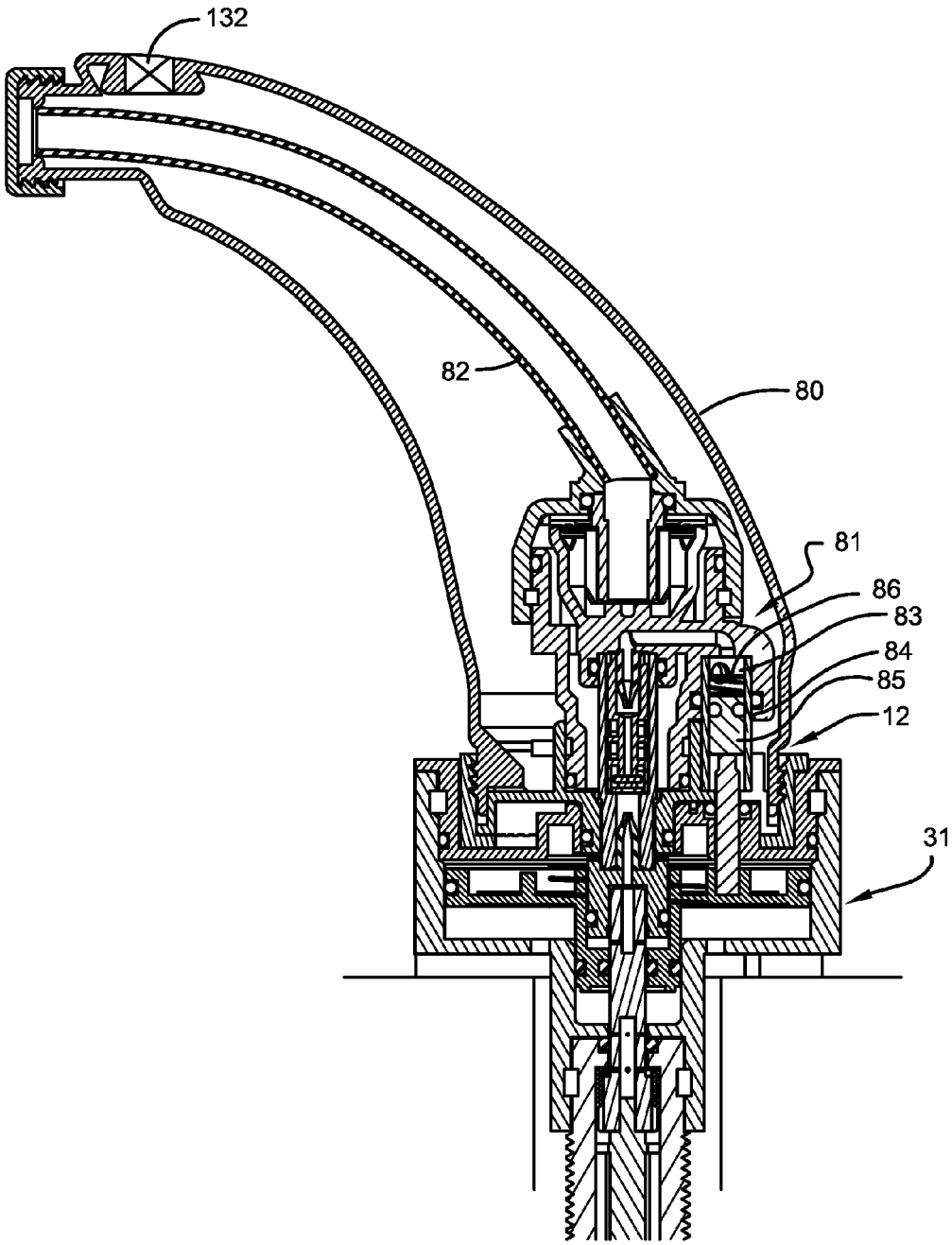
FIG. 13 is a side elevation cross-sectional view of the pump mechanisms held within the housing and through-counter interface the dispensers of FIGS. 1, 2 and 3, shown at an initial configuration of a return state.

From the disclosure above, it should be appreciated that the product chamber 83 and the air chamber 120 change in volume as the dispenser (10, 10*b* or 10*c*) is actuated and the staging chamber 40 is filled and emptied. FIGS. 12 and 13 specifically show the rest state and staging state of the control rod embodiments (FIGS. 1 and 2), and with reference thereto it will be appreciated that, as the staging chamber 40 increases in volume, the piston assembly 41 will be urged upwardly, thereby decreasing the volume of the air chamber 120. Similarly, as the piston assembly 41 moves, the primary piston 124 also moves and pushes on the plug 85. Thus, as the air chamber 120 decreases in volume, the product chamber 83 also decreases in volume.

The product chamber 83, upon decreasing in volume due to the filling of the staging chamber 40 (staging state) and the resultant movement of the plug 85 in the product housing 84, forces a dose of concentrated product into and through the outlet 91 and product passage 92, flow in the opposite direction being prevented by the one-way inlet valve 95. Similarly, the air chamber 120, upon decreasing in volume due to the movement of the piston assembly 41 in the base support member 31, forces a dose of air into and through the air apertures 119 and into an axial passage 130 formed between the interior surface of the axial extension 112 and a channel 131 (FIG. 16) formed in the exterior surface of an overlapping portion of the dilution cartridge 93. The product chamber 83, upon increasing in volume due to the movement of the plug 85 in the product housing 84, draws a vacuum and a dose of concentrated product is drawn into the product chamber through the inlet passage 90 and the one-way inlet valve 95, as there is other way for the concentrated product to flow as a result of the one-way outlet valve 96. Similarly, the air chamber 120, upon increasing in volume due to the movement of the piston assembly 41 in the base support member 31, pulls a vacuum and draws a dose of air into the air chamber through the inlet apertures 126, in the base 33 of the base support member 31 and the one-way inlet valves 127 in the base plate 50 of the piston assembly 41. In this particular embodiment, the one-way inlet valves 127 are formed as apertures 128 and associated flapper valves 129 that are resilient flaps of material (e.g., elastomer) that are held to extend over the apertures 128 and close over them upon a decreasing of the volume of the air chamber 120 and lift off of them to permit the inflow of air upon a increasing of the volume of the air chamber 120. Other valves could be employed. It should be noted that the housing 80 is, in this embodiment, made of a rigid material to form the faucet shape, and, as such, it includes an air inlet valve 132 to permit air to enter the housing 80 as doses of concentrated product are drawn from the housing 80 and advanced to the outlet 13.

Figure 20:
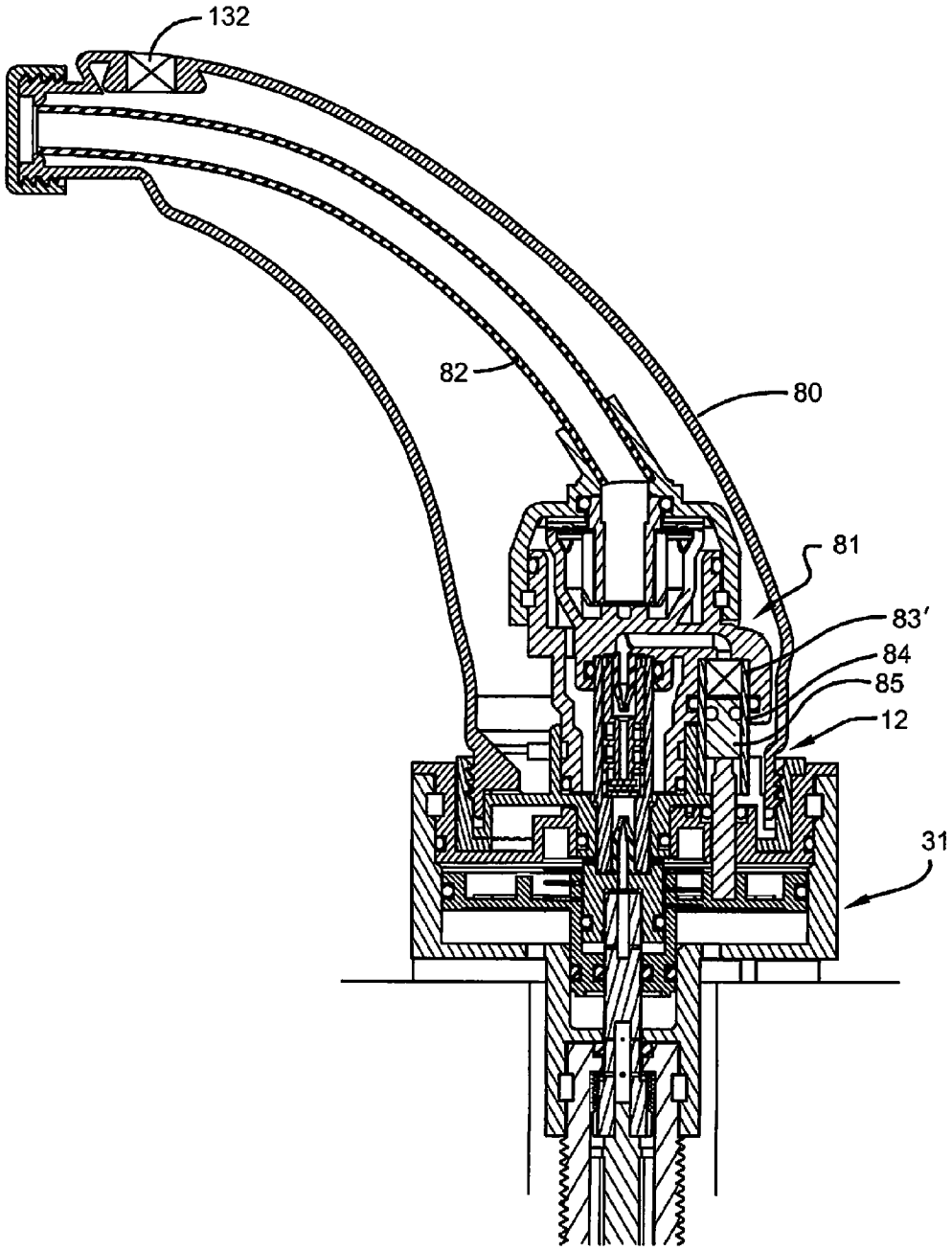
FIG. 20 is a side elevation cross-sectional view of a refill unit in accordance with another embodiment of this invention.

The housing and plug structure (or piston housing and piston) employed to provide the collapsible product chamber 83 could readily be replaced with a dome pump structure. A flexible dome 83' would cover a base structure to define the product chamber 83, and valves and passages would communicate with the product chamber, the concentrated product and the dilution chamber, as generally represented in FIG. 20. In the staging state, the primary piston 124 would impinge upon the dome to collapse the same toward the base, thereby decreasing the volume of the product chamber and advancing concentrated product to the dilution chamber. During the return state, the primary piston 124 would be withdrawn, allowing the dome to expand away from the base to increase in volume and draw a new dose of concentrated product into the product chamber. It should further be appreciated that the air chamber 120 could also alternatively be provided by a dome pump structure with appropriate valves.

Figure 19:
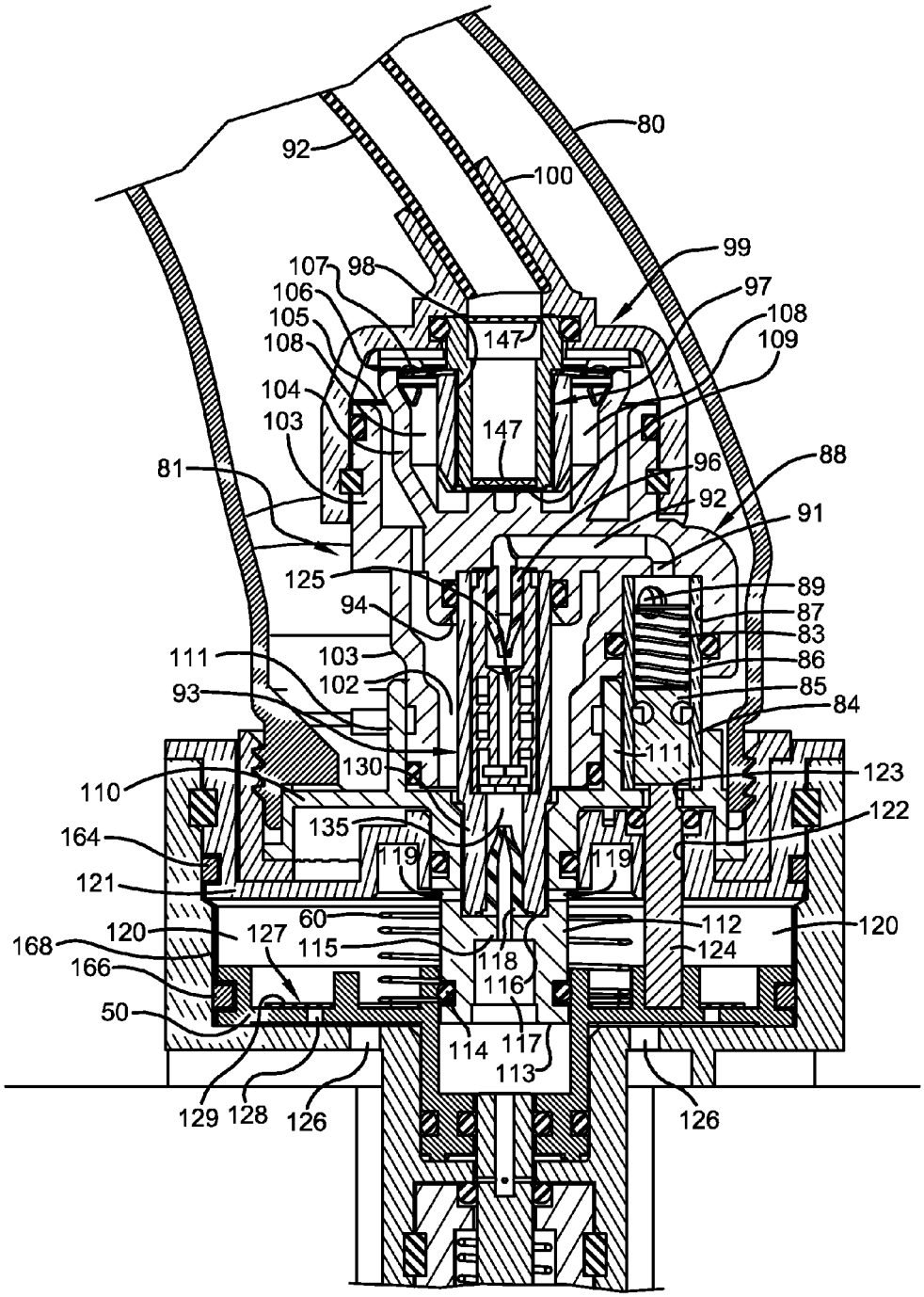
FIG. 19 is a side elevation cross-sectional view showing an enlarged section of an alternative pump mechanism, particularly an alternative air chamber portion defined in part by a membrane, permitting the avoidance of friction-generating o-rings.

It is noted that the movement of the piston assembly 41 can be resisted by the friction between the o-ring 162 and the sidewall 39 of the base support member 31, and therefore, with reference to FIG. 19, the o-ring 162 can be avoided to make the system easier to actuate. Particularly, the o-ring 162 is replaced with a retention ring 164, and the o-ring 160 associated with the mounting plate member 121 is replaced with a retention ring 166. The retention rings 164 and 166 serve to secure a membrane 168 between the piston assembly 41 and the mounting plate member 121, the membrane thus serving to seal the air chamber 120. The retention rings 164 and 166 need only seal the membrane 168 to the mounting plate member 121 and the piston assembly 41, and do not need to seal against the sidewall 39. Thus, there need be little or no friction between the retention ring 164 and the sidewall 39, and the system will be easier to actuate due to the practice of this membrane-bounded air chamber.

As the staging state is established and a dose of concentrated product is expelled from the product chamber 83, it forces product within the passage 92 to enter the dilution chamber 125 within the dilution cartridge 93. Similarly, the contents of the dilution chamber 125 are forced further along in the dispenser, toward the dispenser outlet 13. Likewise, as a dose of air is expelled from the air chamber 120 through the apertures 119 and into the air passage 131, the air in the air passage 102 is advance toward the dispensing outlet 113 because the air passage 131 joins with the air passage 102. Thus, concentrated product and air are advanced through the dispenser toward the dispensing outlet 13 when the volume of the staging chamber 40 is increased. The air passage defined by air passages 102 and 131 bypasses the dilution chamber 125. It will be appreciated that this same advancement of product and air occurs when the valved manifold embodiment is actuated to inject water into the staging chamber 40 (FIG. 10).

The concentrated product dosed into the dilution chamber 125 must be diluted to a useful and safe concentration. Thus, with further reference to the control rod embodiments of FIGS. 12 and 13, it is noted that, when the control rod 36 is moved downwardly so that the staging chamber outlet passage 38 communicates with the staging chamber 40, the water in the staging chamber 40 is advanced to the dosing chamber 117, through the staging chamber outlet passage 38, forcing water already therein to advance further through the dispenser toward the dispensing outlet 13. Most notably, water is advanced into the dilution chamber 125, where it mixes with the concentrated product to dilute the same. It will be appreciated that this same advancement of water from the staging chamber 40 to the dilution chamber 125 occurs in the valved manifold embodiment, when the feed valve 67 is moved to permit communication between the staging conduit 65 and the transfer conduit 68, which, as seen in FIGS. 9-11 communicates with the dilution chamber 125.

Figure 16:
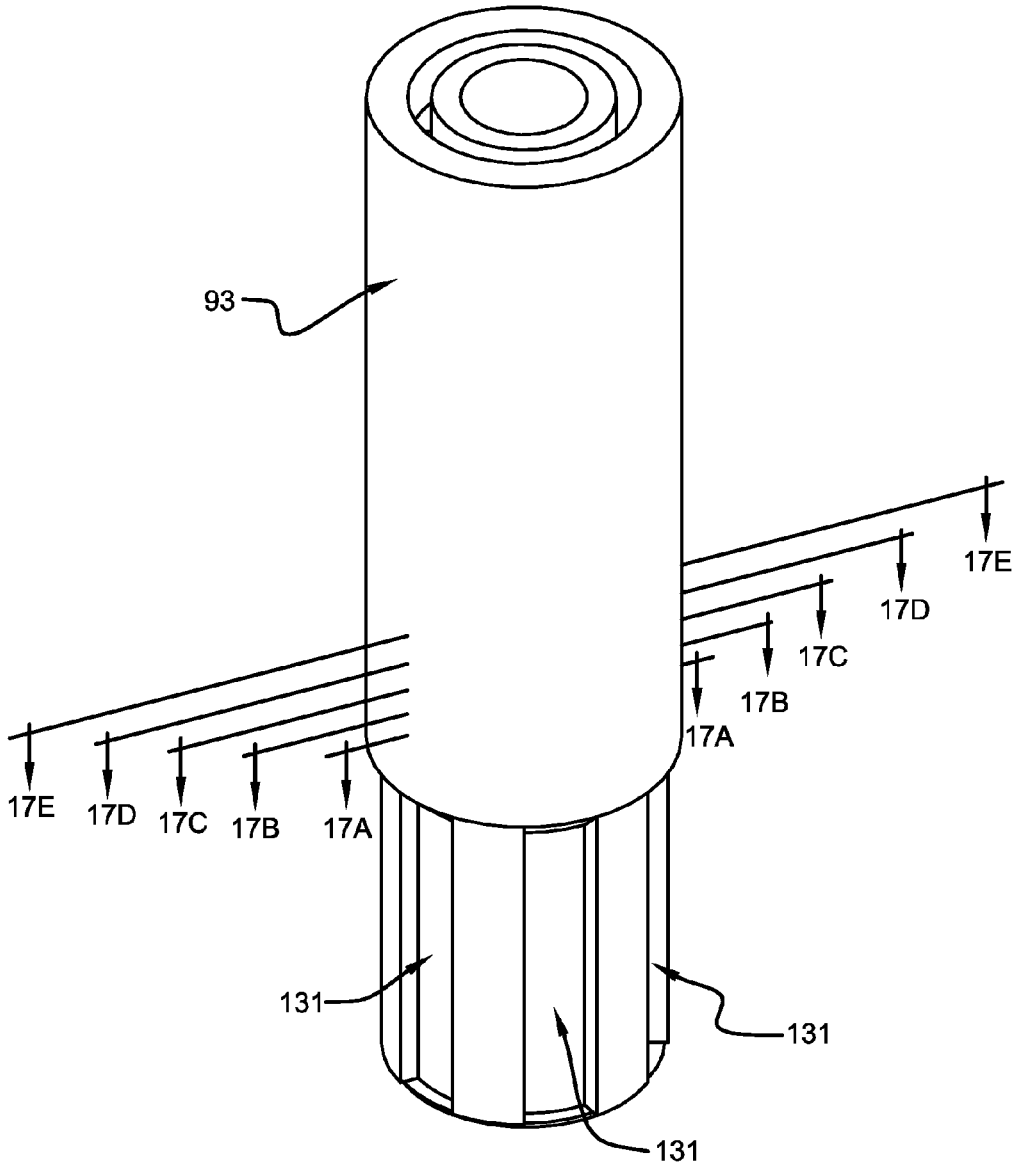
FIG. 16 is a perspective view of a dilution cartridge.
Figure 17A:
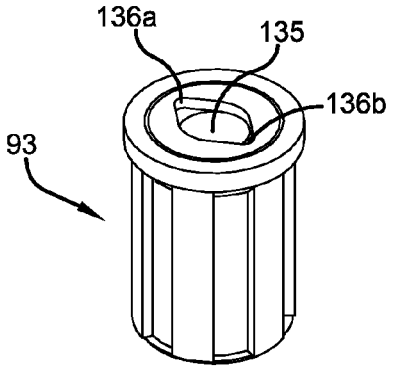
FIGS. 17*a* through 17*e* are perspective views showing various cross-sections of the dilution cartridge in order to show a tortuous path therethrough for diluting concentrated product.
Figure 17B:
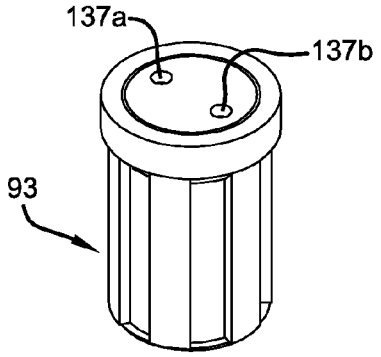
Figure 17C:
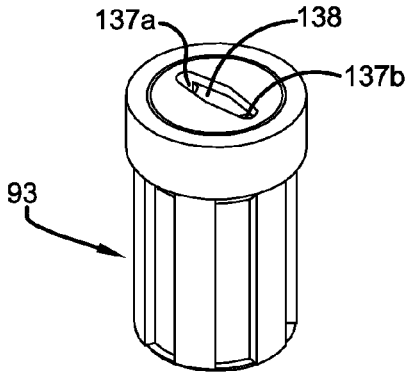
Figure 17D:
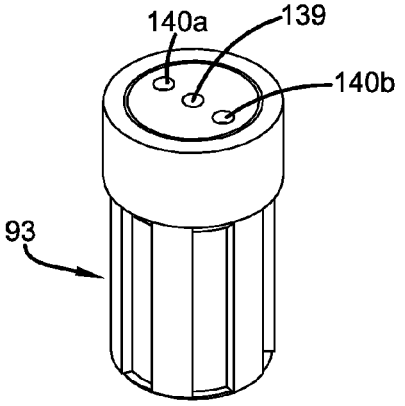
Figure 17E:
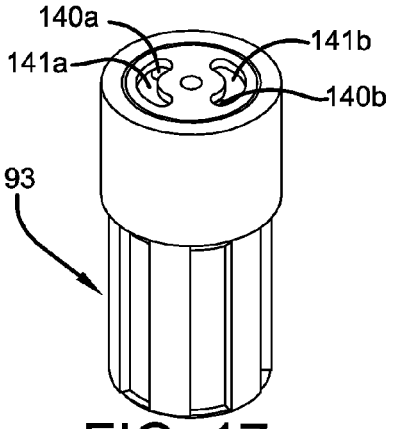

With reference to FIGS. 16 and 17, it can be seen that the dilution chamber 125 is provided as a turbulent path through the dilution cartridge 93. As seen in FIGS. 17*a* through 17*e*, the turbulent path is provided by a plurality of channels through which the concentrated product and water must pass, mixing the same so that the concentrated product is diluted. The water injected into the dilution cartridge 93 initially flows up a central water channel 135 and then flows outwardly at radial channels 136*a* and 136*b* (FIG. 17*a*). Radial channels 136*a* and 136*b* communicate with respective axial channels 137*a* and 137*b* (FIG. 17*b*) that terminate at a mix channel 138 (FIG. 17*c*) that, as seen in FIGS. 17*d* and 18, receives concentrated product flowing down the central product channel 139 from the one-way valve 96, such that the water and concentrated product begin to mix. The water and concentrated product continue to mix to dilute the concentrated product as they flow upwardly through the axial channels 140*a* and 140*b* (FIG. 17*d*), which communicate with respective circumferential channels 141*a* and 141*b* (FIG. 17*e*). The general channel structure of axial channels 140*a*, 140*b* and circumferential channels 141*a*, 141*b* is repeated, as at axial channels 142*a*, 142*b* and circumferential channels 143*a*, 143*b*, which communicate with axial exit channels 144*a* and 144*b* of the dilution cartridge 93. The axial exit channels 144*a* and 144*b* communicate with axial channels 145*a* and 145*b* in the pump interface structure 88. The axial channels 145*a* and 145*b* communicate with the annular space 108 and, thus the concentrated product is diluted with the water by traveling through the tortuous path that defines the dilution chamber 125, and the diluted product is advanced to meet air flowing to the annular space 108

This air and diluted product is advanced through the foaming cartridge 97 where they are further mixed at one or more screens 147 to create a foam product. The foam product is advanced through the passage 100 of the dispensing tube interface 99 and through the dispensing tube 82 to be dispensed at the dispenser outlet 13. It will be readily appreciated that each actuation of the dispensers taught herein, from the rest state through the staging states and return states and back to the rest state, results in the advancement of a dose of concentrated product, a dose of water, and a dose of air, the advancement thereof causing previous doses to advance, mix and ultimately be dispensed as foam. In certain embodiments, the volume of the air chamber 120 is such that the air forced through the system upon a decrease in the volume of the air chamber 120 is sufficient to drive previously diluted product present at the annular space 108 into and through the screens 147 of the foaming cartridge 97 and through the dispensing tube 82 to exit the dispensing outlet 13.

It will be appreciated that the present invention involves the advancing of doses of air, water and concentrated products, the volume of the doses being dictated by the volume of the air chamber 120, the staging chamber 40, and the product chamber 83, respectively. In particular embodiments, the ratio of the volume of the dose of concentrated product to the volume of the dose of water (dose of concentrated product:dose of water) is from 1:5 to 1:20, in other embodiments, from 1:8 to 1:12, and in other embodiments 1:10. It should be appreciated that the volume of diluted product advanced (i.e., the dose of diluted product) will be very near or identical to the sum of the dose of concentrated product and the dose of water. In some embodiments, the ratio the dose of diluted product to the dose of air is from 1:5 to 1:20, in other embodiments, from 1:8 to 1:12, and in other embodiments 1:10. In a particular foam dispenser embodiment, the concentrated product is a soap, and the ratio of the dose of concentrated product to the dose of water is 1:10, while the ratio of the dose of diluted product to the dose of air is 1:10. When not employing air, the concentrated product would simply be diluted by doses of water, and doses of diluted product would be dispensed at the dispensing outlet 13.

Although the embodiments disclosed above are employed to dispense foam by mixing air with the diluted product, it should be readily apparent that the concepts herein can be readily applied to simply dilute a concentrated product and dispense it as an appropriately diluted product. To do this, the concepts disclosed herein would simply be altered to avoid the advancement of air through the system. In the particular embodiments shown, this could be achieved by avoiding the use of the air chamber 120. Simply by removing the flapper valve 129 and the air apertures 119, the piston assembly 41 would no longer serve to advance air through the dispenser and would yet be appropriately sealed. The foaming cartridge 97 could also be removed and the pump interface structure 88 altered to allow for a more direct communication between the dispensing tube 82 and the contents exiting the dilution chamber 125.

In the particular embodiments shown herein, the dispensers benefit by the advantageous employment of what is termed herein a "refill unit." The refill unit includes a product container and pump mechanisms and mates with a remainder of the dispenser to create a complete, working dispenser as already described. Refill units are generally known in, for example, the soap and sanitizer dispensing arts, and typically include a product container and associated pump mechanisms that are installed, as a replaceable unit, in a dispenser housing to create a complete dispenser. As with refill units of the prior art, the refill unit herein is provided so that, when the product within the refill unit is empty, the entire refill unit may be removed from the remainder of the dispensing system and replaced with a new refill unit. Additionally, the refill unit includes the components that are wetted with the product, so the remainder of the system remains sanitary by never coming into contact with the product. Again, this general concept is known in the art of refill units. However, the refill unit disclosed herein is significantly different in structure from those of the prior art.

Figure 14:
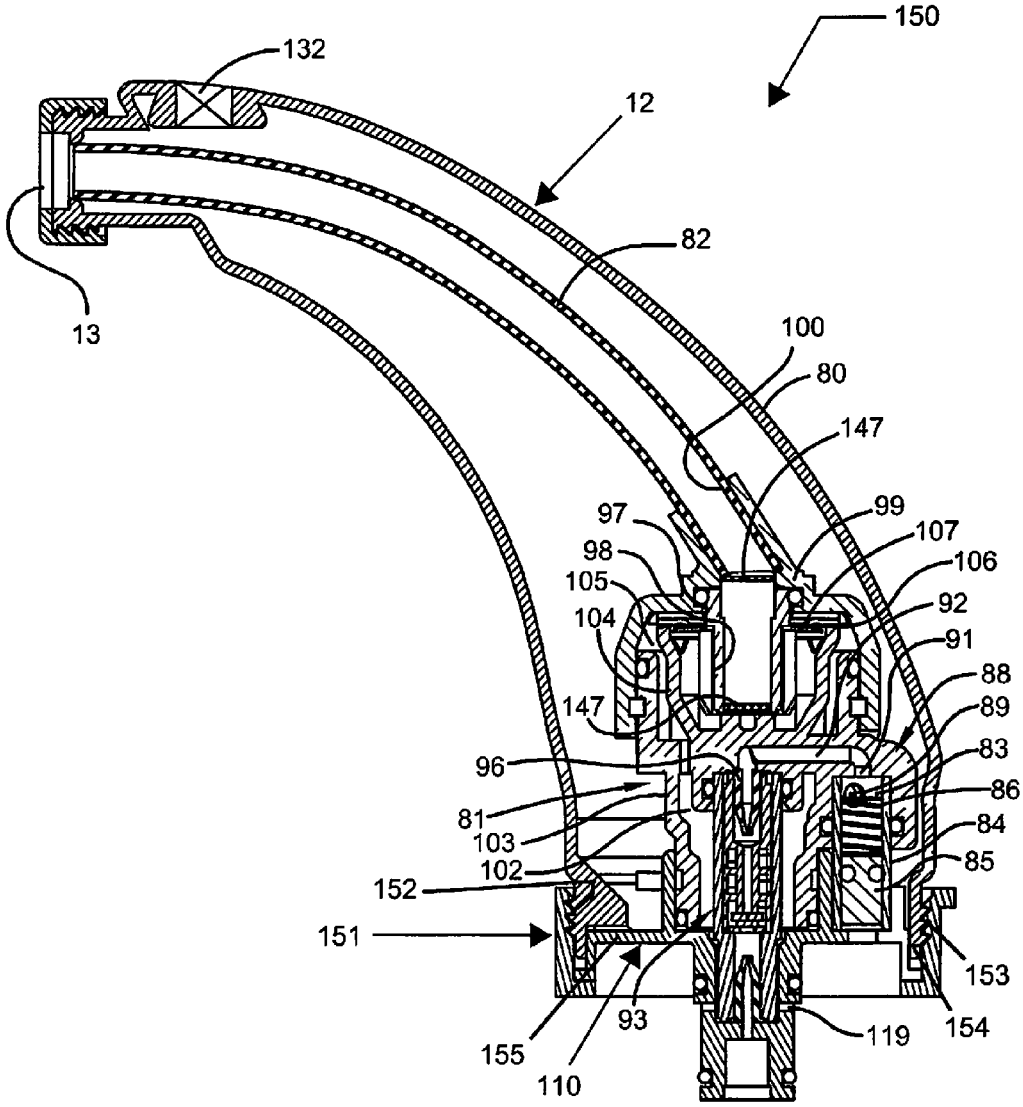
FIG. 14 is a side elevation cross-sectional view of a refill unit in accordance with this invention.

With reference FIG. 14, a refill unit is shown and designated by the numeral 150. How this refill unit mates with the remainder of the dispenser 10 can be seen in various figures, including FIG. 12. To create the desired refill unit, the pump interface structure 88, the various elements interfacing with the pump interface member 88 (e.g., housing 84, plug 85, dilution cartridge 93, foaming cartridge 97, dispensing tube interface 99) and the dispensing tube 82 are retained within the housing assembly 12 by a cap 151. More particularly, the cap 151 includes threads 152 that mate with threads 153 proximate the open end 154 of the housing assembly 12 to pinch a flange 155 of the retention plate member 110 against the rim at the open end 154. The housing assembly 12 also retains the concentrated product, and an appropriate seal may be used to prevent leakage of concentrated product at the cap 151. With reference to FIG. 12, it can be seen that this refill unit 150 can simply be inserted into the base support member 31 to rest on the mounting plate member 121. When mounted in this manner, a complete a dispenser is formed to function as already described above. It should be appreciated that this refill unit 150 can readily be adapted as already mentioned above in order to dispense a diluted product instead of a diluted product that is mixed with air to create a foam product.

This refill unit 150 includes a faucet-shaped housing 80, and, as such, it can serve to provide the exterior appearance of the dispenser, above the counter. However, it should be readily appreciated that a separate and more permanent counter-mounted housing could be mounted to the counter to receive a refill unit having a housing that is not shaped as a faucet but is simply shaped to be received in the more permanent counter-mounted housing. Indeed, the counter-mount environment is merely one option for the installation of systems in accordance with this invention, and the concepts herein are readily adaptable to present as wall-mounted dispensing systems and in otherwise.

In light of the foregoing, it should be appreciated that the present invention significantly advances the art by providing a product dispenser that employs a concentrated product and dilutes it before dispensing to an end user. The art is also advanced through the provision of the aforementioned dispenser wherein the diluted product is further mixed with air to be dispensed as foam in some embodiments. In yet other embodiments, the art is advanced by the provision of a particular refill unit useful in accordance with the concepts taught herein. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A refill unit for a product dispenser, the refill unit comprising:

a supply of concentrated product;

a dilution chamber having an inlet for said concentrated product and an inlet for water;

a product pump mechanism including:

a product chamber that fluidly communicates with said supply of concentrated product and fluidly communicates with said dilution chamber, said product chamber structured to decrease in volume upon actuation of said product pump mechanism to thereby drive a dose of product from said product chamber toward said dilution chamber, said product chamber further structured to increase in volume after actuation of said product pump mechanism to thereby draw a dose of product from said supply of concentrated product into said product chamber, wherein said supply of concentrated product, said dilution chamber, said product pump and said product chamber form an entire unit suitable for removal and replacement as a unit from a product dispenser.

2. The refill unit of claim 1, wherein said concentrated product is concentrated soap.

3. The refill unit of claim 1, wherein said dilution chamber includes a tortuous mixing path having a soap inlet, a water inlet and an exit.

4. The refill unit of claim 1, wherein the product chamber is defined by a plug maintained in a plug housing.

5. The refill unit of claim 1, wherein said product chamber is defined by a flexible dome moveable toward a base to decrease the volume of said product chamber.

6. The refill unit of claim 1, further comprising a housing, said supply of concentrated product and said product pump mechanism being held within said housing.

7. The refill unit of claim 6, wherein said housing is faucet-shaped to provide a common faucet-type appearance in use in a counter-mounted product dispenser.

8. The refill unit of claim 6, further comprising a dispensing tube fluidly communicating with said dilution chamber and extending through said housing to a dispensing outlet.

9. The refill unit of claim 8, further comprising a foaming chamber, said dilution chamber fluidly communicating with said foaming chamber.

10. The refill unit of claim 9, further comprising an air inlet communicating with an air passage that bypasses said dilution chamber to fluidly communicate with said foaming chamber.

11. A refill unit for a product dispenser, the refill unit comprising:

a supply of concentrated product;

a dilution chamber having an inlet for said concentrated product and an inlet for water;

a product pump mechanism including:

a product chamber that fluidly communicates with said supply of concentrated product and fluidly communicates with said dilution chamber, said product chamber structured to decrease in volume upon actuation of said product pump mechanism to thereby drive a dose of product from said product chamber toward said dilution chamber, said product chamber further structured to increase in volume after actuation of said product pump mechanism to thereby draw a dose of product from said supply of concentrated product into said product chamber, further comprising a retention plate member having a piston aperture therein, said piston aperture providing access to said product chamber.

12. A dispenser for dispensing a diluted form of a concentrated product, the dispenser comprising:

a supply of concentrated product;

a dilution chamber;

a product pump mechanism including:

a product chamber that fluidly communicates with said supply of concentrated product and fluidly communicates with said dilution chamber, and a water staging chamber; and an actuation assembly having a rest state, a staging state and a return state, said actuation assembly receiving water under pressure from a pressurized water supply, wherein, in said staging state, water from said pressurized water supply is fed to said water staging chamber, increasing the volume thereof and causing the actuating of said pump mechanism by decreasing the volume of said product chamber and thereby driving a dose of product into said dilution chamber, and, in said return state, (a) water within said water staging chamber exits said water staging chamber, (b) water is advanced to said dilution chamber and mixes with said dose of product to create diluted product, and (c) said product chamber increases in volume and draws a dose of product from said supply of concentrated product into said product chamber.

13. The dispenser of claim 12, further comprising a housing, said supply of concentrated product and said product pump mechanism being held within said housing.

14. The dispenser of claim 12, wherein said actuation assembly includes a valved manifold, wherein, in said rest state, said valved manifold blocks the passage of water under pressure from said pressurized water source to said staging chamber, and, in said staging state, said valved manifold provides fluid communication between said staging chamber and the water under pressure from said pressurized water source, such that water under pressure from said pressurized water source enters said staging chamber, and, in said return state, said valved manifold provides fluid communication between said staging chamber and said dilution chamber, such that the water within said staging chamber advances toward said dilution chamber.

15. The dispenser of claim 12, wherein said housing, said supply of concentrated product, said dilution chamber and said product pump mechanism are provided in a refill unit that is removable as a unit from the dispenser so as to be replaced with a new refill unit.

16. The dispenser of claim 12, a dispensing tube fluidly communicating with said dilution chamber and extending to a dispensing outlet.

17. The dispenser of claim 12, wherein said product pump mechanism includes a piston assembly having a product piston reciprocally received in said product chamber said product piston being biased toward a rest position, and in said staging state, increasing the volume of said staging chamber results in the actuating of said pump mechanism by moving said product piston to decrease the volume of said product chamber and drive a dose of product into said dilution chamber.

18. The dispenser of claim 17, further comprising a plug in said product chamber, wherein said product piston contacts said plug to move said plug.

19. The dispenser of claim 12, wherein said actuation assembly includes a control rod reciprocally movable within a drive-water sleeve that holds water under pressure from said pressurized water supply, said control rod having a staging chamber inlet passage and a staging chamber outlet passage, wherein, in said rest state said control rod blocks the passage of water from said drive-water sleeve to said staging chamber, and, in said staging state, said control rod is moved so that said staging chamber inlet passage provides fluid communication between said staging chamber and the water within the said drive-water sleeve, such that water under pressure from said pressurized water supply enters said staging chamber, and, in said return state, said control rod is moved to be returned to its rest position and said staging chamber outlet passage provides fluid communication between said staging chamber and said dilution chamber, such that the water within said staging chamber advances through said staging chamber outlet passage toward said dilution chamber.

20. The dispenser of claim 19, wherein said actuation assembly is driven by a solenoid, gearbox or eccentric.

21. The dispenser of claim 19, wherein said actuation assembly includes a manually-driven plunger, said plunger operatively connected to said control rod such that manually pressing said plunger moves said control rod to said staging state.

22. The dispenser of claim 12, further comprising an air pump mechanism.

23. The dispenser of claim 22, further comprising a foaming chamber, said dilution chamber fluidly communicating with said foaming chamber.

24. The dispenser of claim 23, wherein said air pump mechanism includes:

an air chamber that fluidly communicates with ambient air and fluidly communicates with said foaming chamber, said foaming chamber receiving and mixing said diluted product and air from said air pump mechanism to create a foam product.

* * * * *